US006955069B2

(12) United States Patent
Segawa et al.

(10) Patent No.: US 6,955,069 B2
(45) **Date of Patent: *Oct. 18, 2005**

(54) DOOR LOCKING HANDLE ASSEMBLY WITH BUILT-IN COMBINATION LOCK

(75) Inventors: Shirou Segawa, Tokyo (JP); Aturou Sugimura, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/255,028

(22) Filed: Sep. 25, 2002

(65) Prior Publication Data

US 2003/0136160 A1 Jul. 24, 2003

(30) Foreign Application Priority Data

Jan. 21, 2002 (JP) ..... 2002-010931

(51) Int. Cl.[7] ..... E05B 13/10

(52) U.S. Cl. ..... 70/208; 70/213; 70/215; 70/284; 70/285; 70/312; 70/446

(58) Field of Search ..... 70/208, 284, 285, 70/210, 213, 215, 219, DIG. 63, 312, 446, 315–318, 331, 442, 443, DIG. 1, DIG. 44, DIG. 59

(56) References Cited

U.S. PATENT DOCUMENTS 427,421 A * 5/1890 Jackson
4,353,231 A * 10/1982 Uyeda ..... 70/316
5,347,834 A * 9/1994 Ramsauer ..... 70/120
6,508,089 B1 * 1/2003 Tsai ..... 70/213
6,516,641 B1 * 2/2003 Segawa ..... 70/208
6,550,296 B2 * 4/2003 Segawa ..... 70/208
2002/0083745 A1 * 7/2002 Hartel et al. ..... 70/208
2002/0104341 A1 * 8/2002 Hartel et al. ..... 70/208
2002/0124608 A1 * 9/2002 Segawa ..... 70/208
2002/0139155 A1 * 10/2002 Franzen ..... 70/213

* cited by examiner

*Primary Examiner*—Lloyd A. Gall
(74) *Attorney, Agent, or Firm*—Martin Smolowitz

(57) ABSTRACT

In the handle assembly, a combination lock (6) is disposed adjacent to a cylinder lock (13) in the handle (2). A locking plate (11) is interlocked with a rotor (8) of the lock (13), and it engages with a shoulder (15) of a receiver lever (16), which is a intermediate actuating member, so that the door handle (2) is held in its folded position. When the combination lock (6) is held in its unlocked condition and the handle (2) is pulled, the receiver lever (16) is swung upward by the locking plate (11) to release the handle (2) from the body (1). Each of the predetermined mark of each of the marked dial discs (4) for unlocking is detected by turning each of the marked dial discs (4) until the resetting member (72) is brought into engagement with each of the detecting grooves (71).

10 Claims, 22 Drawing Sheets

DOOR LOCKING HANDLE ASSEMBLY WITH BUILT-IN COMBINATION LOCK

BACKGROUND OF THE INVENTION

1. Field of Invention

The present invention relates to a door locking handle assembly with a built-in combination lock of a pull-out and side-swinging lever-action type, in which a door handle is pivoted to a base body of the assembly so as to be pulled out forward and pushed back rearward relative to the base body and turned on its pivoted end.

2. Description of the Related Art

As is well known in the art, a door locking handle assembly of a conventional type has a construction in which: a base body of the assembly is fixedly mounted on a door of a box or container; a door handle is pivoted to the base body so as to be pulled out forward and pushed back rearward relative to the base body and further turned sideward on its pivoted end after completion of its pulling-out operation; when the door handle is pulled out of the base body to assume its pulled-up or raised inclination position relative to the base body and turned sideward after completion of its pulling-out operation, a catch plate (i.e., locking member) which serves as a door bolt directly or indirectly connected with the door handle is released from a receiving portion of a stationary frame element (i.e., door frame) of the box or container. In this type of conventional door locking handle assembly, a cylinder lock is incorporated in either the door handle or the base body. On the other hand, the door handle is pushed back rearward relative to the base body and held in its folded position or locked position in the base body.

In the conventional door locking handle assembly having the above construction, an available space for mounting the assembly is extremely limited in each of opposite sides of the door to which the assembly is fixedly mounted because the interior space of the box or container for housing various instruments therein is relatively limited due to the presence of the instruments housed in the box or container. Due to this, it is necessary to considerably limit in size the projections of the assembly in opposite directions perpendicular to the plane of the door's surface.

In order to fulfill the above need, it is necessary to reduce in thickness the assembly as a whole by reducing in thickness the door handle and in depth the base body. However, this forces the cylinder lock of the assembly to be considerably reduced in thickness.

On the other hand, in such a thin-type cylinder lock, since the number of sets of disc tumblers and/or pin tumblers incorporated in the cylinder lock as essential components of its internal lock mechanism is small, the number of available keys of such a thin-type cylinder lock is naturally limited. Due to this, in the case where there are a large number of eligible users or persons using the instruments contained in the box which is provided with the door locking handle assembly employing the cylinder lock in a condition in which these users or persons are controlled by a control operator through a computerized personal management system, it is difficult to use the conventional door locking handle assembly which employs the thin-type cylinder lock.

SUMMARY OF THE INVENTION

Under such circumstances, the present invention was made. Consequently, it is an object of the present invention to provide a door locking handle assembly with a built-in combination lock, which assembly is thin in thickness as a whole and capable of providing a very large number of available keys for the combination lock, wherein a large number of eligible persons or users of various instruments contained in a box or container provided with the door locking handle assembly are precisely controlled by a control operator through a computerized personal management system.

Another object of the present invention is to provide a door locking handle assembly with a built-in combination lock, in which a predetermined combination of marks of marked dial discs of a combination lock can be correctly reset with detecting a predetermined marks of each of said marked dial discs by a simple operation, even when users of the door locking handle assembly forgot the predetermined combination of marks of marked dial discs.

It is possible to accomplish the above object of the present invention of claim 1 by providing:

in a door locking handle assembly with a built-in combination lock of claim 1, the assembly being provided with a base body 1 which is fixedly mounted on a door 30 of a box, wherein a handle 2 is pivoted to said base body 1 so as to be capable of being pulled out forward and pushed back rearward relative to said base body 1 and also turned sideward on a locking shaft 29 after completion of its pulling-out operation, wherein a locking member 3 serving as a door bolt for locking said door 30 to a main body of said box is directly or indirectly connected with said handle 2 so as to be engaged with and disengaged from a receiving portion of a stationary frame element such as said main body of said box when said handle 2 is pulled out forward and then turned sideward on said locking shaft 29 after completion of the pulling-out operation of said handle 2, the improvement wherein:

said combination lock 6, which is provided with a plurality of marked dial discs 4, is incorporated in said handle 2 and opened by turning each of said marked dial discs 4 a given number of times to establish a predetermined combination of marks for unlocking, which are provided in outer peripheral surfaces of said dial discs 4;

said combination lock 6 is held in its locked condition, when said predetermined combination of marks for unlocking is not established;

a cylinder lock 13 is incorporated in said handle 2 and disposed adjacent to said combination lock 6 in a longitudinal direction of said handle 2, wherein said cylinder lock 13 is provided with a rotor 8;

when a key 7 is inserted into a keyhole 9 of said rotor 8 of said cylinder lock 13, said cylinder lock 13 has its internal lock mechanism 10 unlocked to permit said rotor 8 to be turned by said key 7 thus inserted into said keyhole 9 of said rotor 8;

an intermediate actuating member is disposed between the combination lock 6 and the cylinder lock 13 in such a manner that the handle 2 can be pulled out forward relative to said base body 1, when the combination lock 6 is brought into its unlock condition under the circumstances wherein the cylinder lock 13 is held in its lock condition, or, when the cylinder lock 13 is brought into unlock condition under the circumstances wherein the combination lock 6 is held in its lock condition.

The door locking handle assembly of the invention of claim 2 has the same construction as set forth in claim 1, and has further the following construction, wherein:

said combination lock 6 is constructed in such a manner that a locking plate 5 is brought into its unlocked position, when a plurality of marked dial discs 4 is turned so as to establish a predetermined combination of marks for unlocking, which are provided in outer peripheral surfaces thereof, while the locking plate 5 is held in its locked position, when said predetermined combination of marks for unlocking is not established;

said cylinder lock 13 is constructed in such a manner that its internal lock mechanism 10 is brought into its unlocked by inserting the key 7 into the keyhole 9 of said rotor, and then a stopping plate 11 is projected outward and retracted inward through a side hole 12 of said handle 2;

said intermediate actuating member is constructed by a receiver lever 16 which has its proximal end portion pivoted to an inner wall portion of said base body 1 through a pivot 17;

Said stopping plate 11 has its upper end portion 14 abut against a shoulder portion 15 of a lower surface of a proximal end portion of a receiver lever 16;

said shoulder portion 15 of said receiver lever 16 is provided with a cam slope 18 through which said receiver lever 16 is pushed upward by said upper end portion of said stopper plate 11;

said receiver lever 16 is urged toward said stopping plate 11 by means of a first spring member 19;

a slider 21 is disposed in parallel with a center pin 20 of said combination lock 6, and urged toward said cylinder lock 13 by means of a second spring member 22 in a manner such that a lower end portion 23 of said slider 21 abuts against an upper surface of said receiver lever 16, so that said slider 21 has its restriction portion 26 engaged with and disengaged from a locking end portion 25 of said lock plate 5 when said lock plate 5 is held in its locked position and its unlocked position, respectively.

When said lock plate 5 is held in its unlocked position, said handle 2 is capable of being pulled forward out of said base body 1;

when said handle 2 is thus pulled out forward, said stopping plate 11 pushes said cam slope 18 of said receiver lever 16 swingably upward so that said receiver lever 16 is moved to its unlocked position; and when said lock plate 5 is held in its locked position, said lock plate 5 has its locking end portion 25 engaged with said restriction portion 26 of said slider 21 to prevent said receiver lever 16 from turning on said first pivot 17.

The door locking handle assembly of the invention of claim 3 has the same construction as set forth in claim 1 or claim 2, and has further the following construction, wherein:

said combination lock 6 is provided with a plurality of cam discs 41 which are used for changing the predetermined combination of marks of said dial discs 4 by engaging with and disengaging from said discs 4;

each of cam discs 41 is provided with a detecting groove 71 on its peripheral surface;

said handle 2 is provided with a plurality of openings 75 which permit a resetting member 72 to access to said peripheral surface of each of said cam discs 41;

said resetting member 72 is contacted on the peripheral surface of each of said cam discs 41 through said opening 75;

each of said predetermined mark for unlocking of each of said marked dial discs 4 is detected by turning each of said marked dial discs 4 until said resetting member 72 is brought into engagement with each of said detecting grooves 71.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
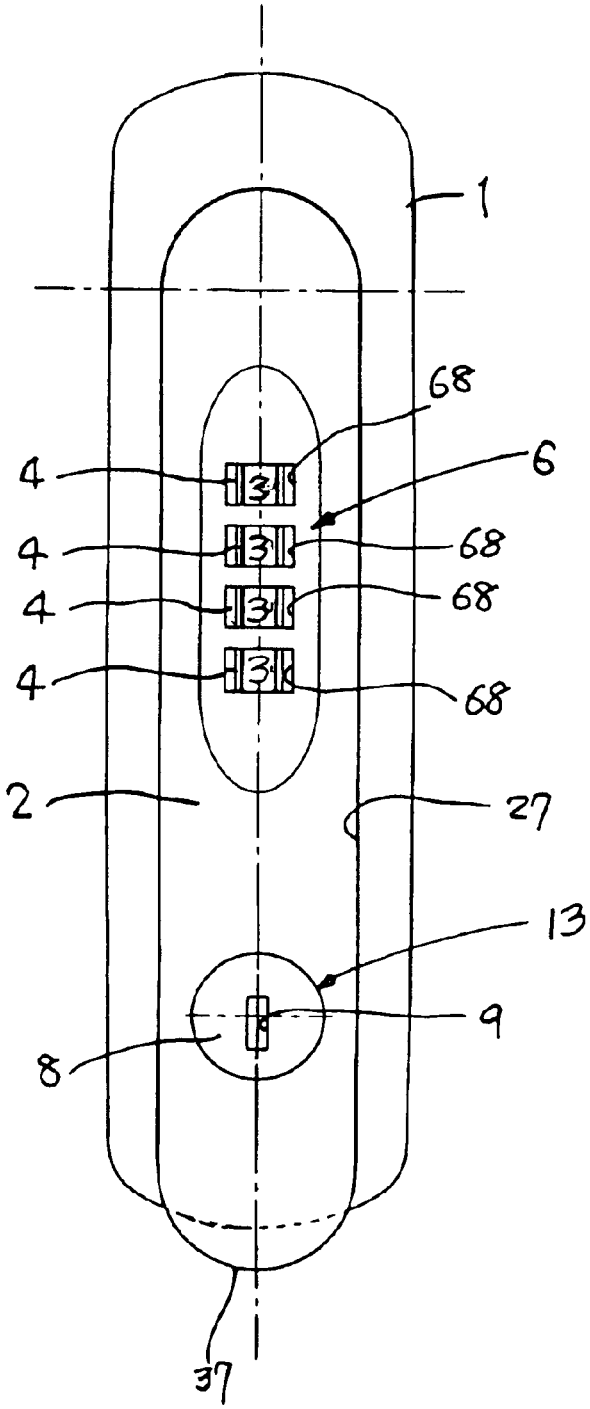
FIG. 1 is a front view of an embodiment of the door locking handle assembly of the present invention.

The best modes for carrying out the present invention will be described in detail using embodiments of the invention with reference to the accompanying drawings.

As shown in FIGS. 1 to 4, an embodiment of a door locking handle assembly of the present invention is provided with a base body 1 which is fixedly mounted on a door 30 of a box. A handle 2 is pivoted to said base body 1 so as to be capable of being pulled out forward and pushed back rearward relative to said base body 1 and also turned sideward on a locking shaft 29 after completion of its pulling-out operation. A locking member 3 serving as a door bolt for locking said door 30 to a main body of said box is directly or indirectly connected with the handle 2 so as to be engaged with and disengaged from a receiving portion of a stationary frame element such as the main body of said box when the handle 2 is pulled out forward and then turned sideward on the locking shaft 29 after completion of the pulling-out operation of the handle 2.

In such a door locking handle assembly having the above construction, the combination lock 6 is provided with a plurality of marked dial discs 4. The combination lock 6 is incorporated in the handle 2, and opened by turning each of the marked dial discs 4 a given number of times to establish a predetermined combination of marks for unlocking, which are provided in outer peripheral surfaces of the dial discs 4.

The combination lock 6 is held in its locked condition, when the predetermined combination of marks for unlocking of said dial discs 4 is not established.

A cylinder lock 13 is incorporated in the handle 2 and disposed adjacent to the combination lock 6 in a longitudinal direction of said handle 2, wherein said cylinder lock 13 is provided with a rotor 8.

When a key 7 is inserted into a keyhole 9 of said rotor 8 of said cylinder lock 13, the cylinder lock 13 has its internal lock mechanism 10 unlocked to permit the rotor 8 to be turned by the key 7 thus inserted into the keyhole 9 of the rotor 8.

An intermediate actuating member is disposed between the combination lock 6 and the cylinder lock 13 in such a manner that the handle 2 can be pulled out forward relative to the base body 1, when the combination lock 6 is brought into its unlock condition under the circumstances wherein the cylinder lock 13 is held in its lock condition, or, when the cylinder lock 13 is brought into unlock condition under the circumstances wherein the combination lock 6 is held in its lock condition.

A control operator of the instruments housed in the box is capable of allocating to each of a large number of eligible users or persons such a predetermined unique combination of marks of the marked dial discs 4 of the combination lock 6 for unlocking and locking the combination lock 6.

Each of the eligible users or persons is capable of unlocking the combination lock 6 of the door locking handle assembly by turning in a normal or a reverse direction each of the marked dial discs 4 a given number of times to establish the unique combination of the marks for unlocking, which combination has been allocated to each of the eligible users or persons, wherein the marks are provided in an outer peripheral surface of each of the dial discs 4.

Figure 4:
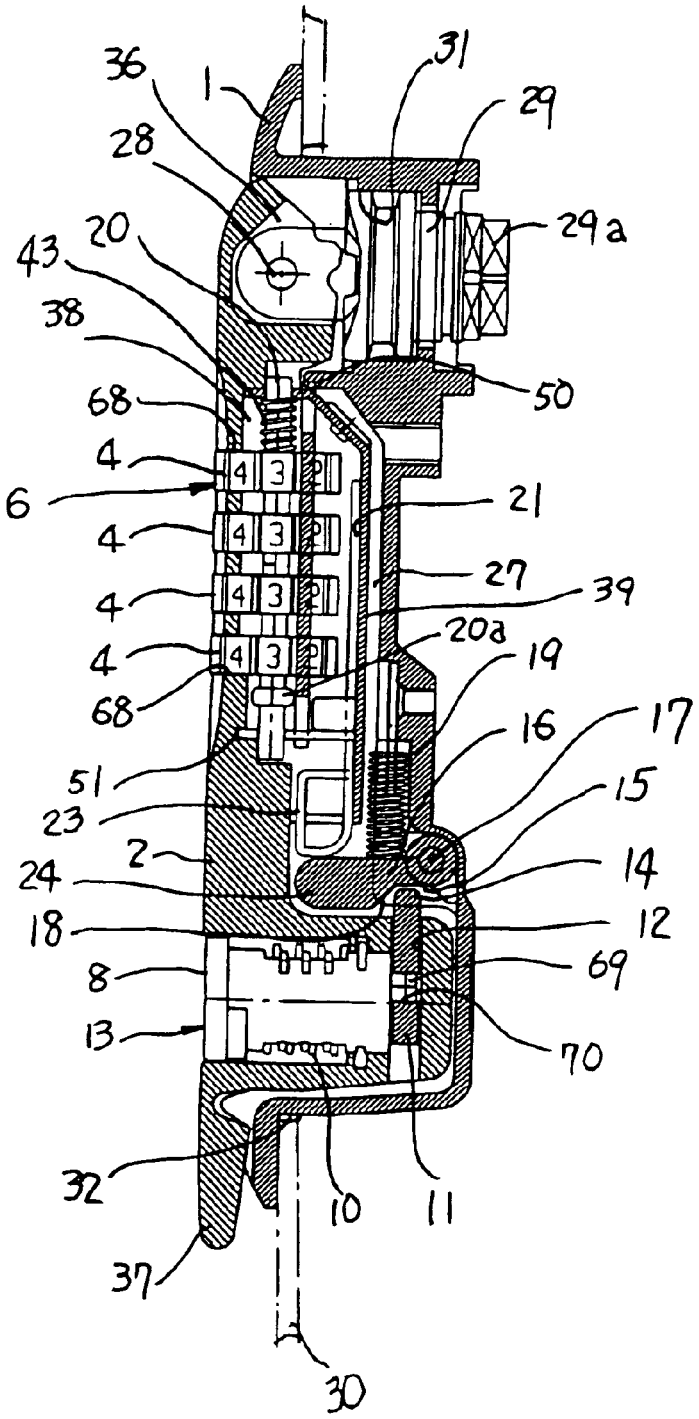
FIG. 4 is a schematic longitudinal sectional view of the door locking handle assembly shown in FIG. 1, illustrating a predetermined unique combination of the marks of the dial discs of the combination lock.
Figure 14:
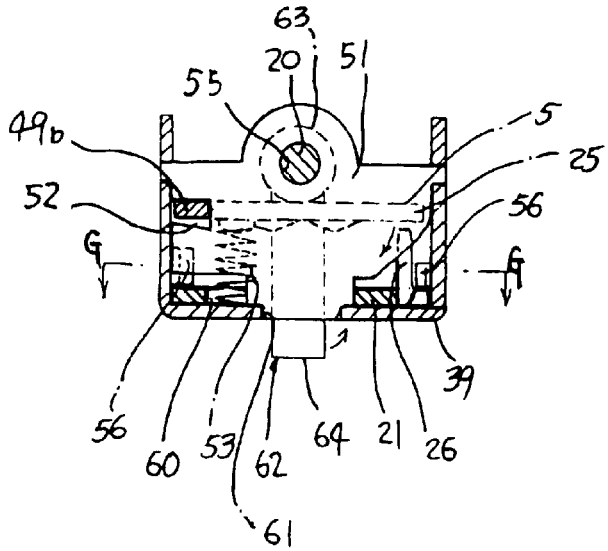
FIG. 14 is a cross-sectional view of combination lock, taken along the line A—A of FIG. 2.
Figure 15:
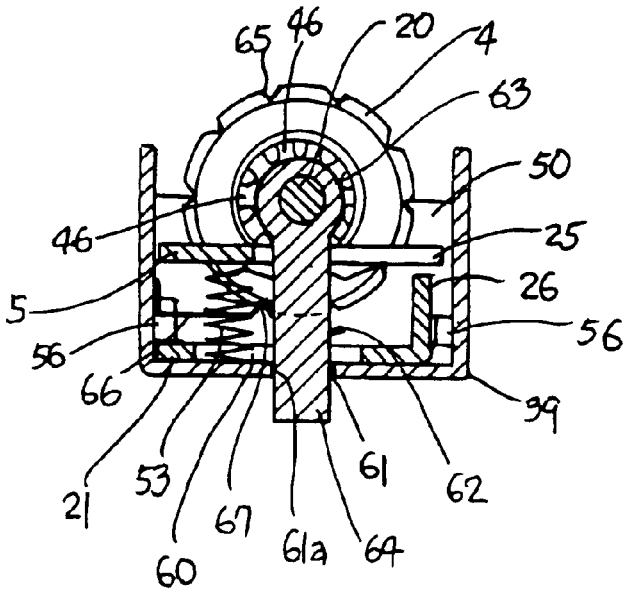
FIG. 15 is a cross-sectional view of combination lock, taken along the line B—B of FIG. 2.

Once such a predetermined unique combination of the marks for unlocking is established, as shown in FIG. 4, the combination lock 6 is unlocked and therefore capable of moving to its unlocking position. In such an unlocked condition of the combination lock 6, as shown in FIGS. 14 and 15, the locking end portion 25 of the lock plate 5 is in a predetermined advanced position in which: the locking end portion 25 of the lock plate 5 is released from the restriction portion 26 of the slider 21; and, the slider 21 is capable of moving upward as viewed in FIG. 4. At this time, the cylinder lock 13 is in its locked condition, so that the upper end portion 14 of the stopping plate 11 is engaged with the shoulder portion 15 of the receiver lever 16 under the influence of a resilient force exerted by the first spring member 19. As a result, the handle 2 is held in its folded position inside a front concave portion 27 of the base body 1.

Figure 5:
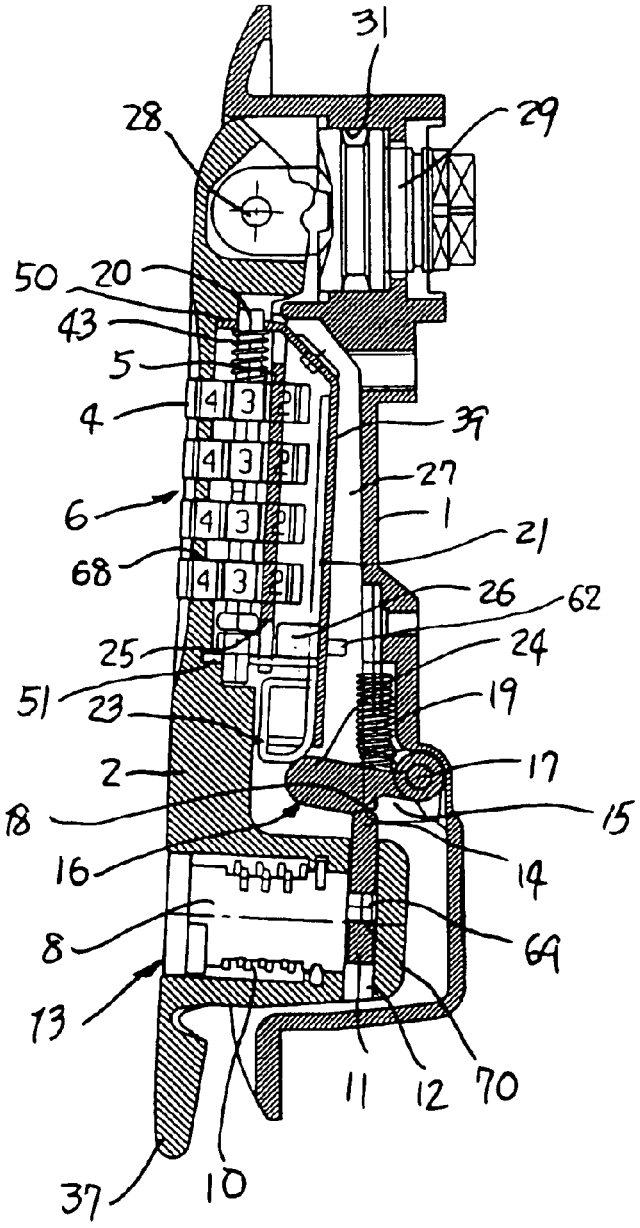
FIG. 5 is a schematic longitudinal sectional view of the door locking handle assembly shown in FIG. 4, illustrating the door handle having been slightly pulled out of the base body in a swing manner.
Figure 6:
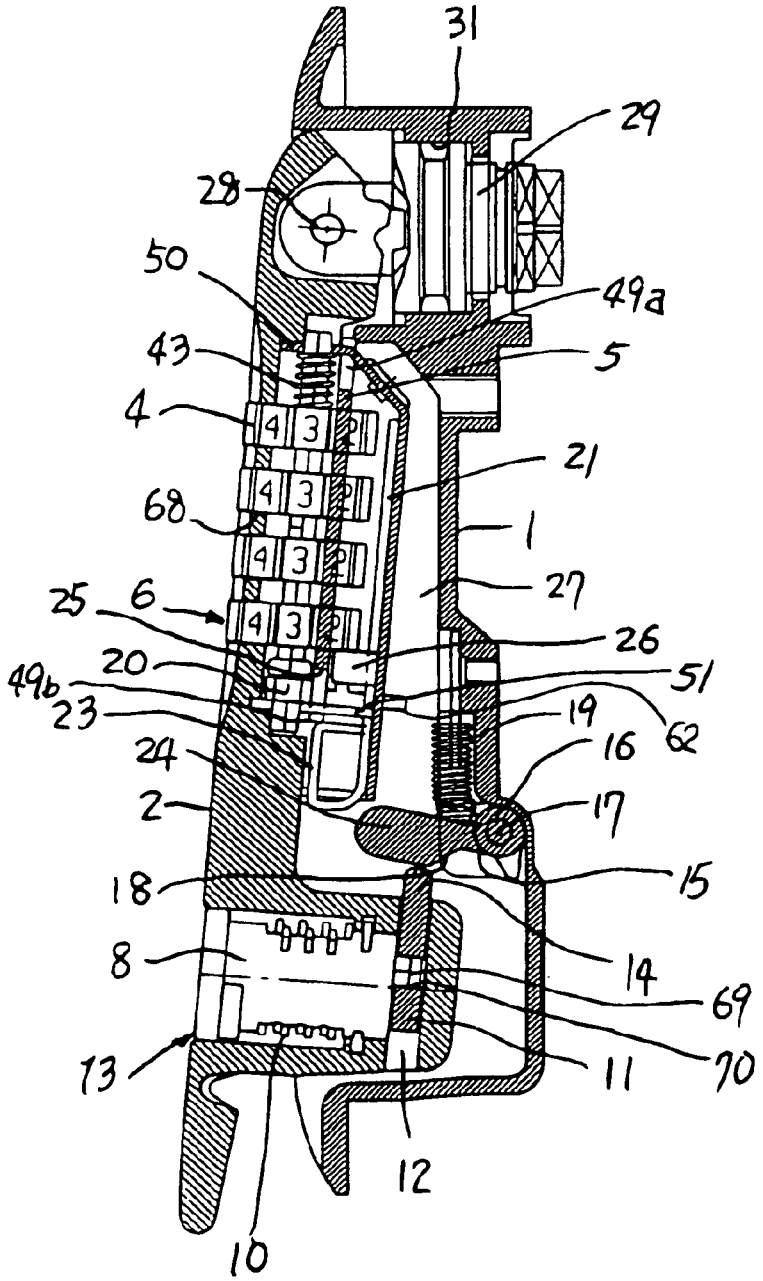
FIG. 6 is a schematic longitudinal sectional view of the door locking handle assembly shown in FIG. 4, illustrating the door handle further apart from the base body than in FIG. 5.

Under such circumstances, when the handle 2 is forcibly pulled forward out of the base body 1, as shown in FIG. 5, the door handle 2 is turned on a second pivot 28. As a result, the upper end portion 14 of the stopping plate 11 pushes swingably up the cam slope 18 of the shoulder portion 15 of the receiver lever 16. Due to such pushing operation of the stopping plate 11, the receiver lever 16 is turned on the first pivot 17 to unlock the handle 2. At the same time, the receiver lever 16 pushes up a lower end portion 23 of the slider 21 so that the slider 21 is retracted upward from its lower extended position.

At a stage in which the door handle 2 is swingably pulled out of the base body 1 to reach a predetermined angular position thereof, the receiver lever 16 is released from a pushing force exerted by the upper end portion 14 of the stopping plate 11. Due to this, as is clear from FIG. 7, the receiver lever 16 swingably returns to its initial rest position under the influence of a resilient force exerted by the first spring member 19. At this time, the slider 21 also returns downward to its initial lower position under the influence of a resilient force exerted by the second spring member 22 (shown in FIG. 23).

When the handle 2, which is in its raised position, is turned sideward on the locking shaft 29, the locking member 3 which is directly or indirectly connected with the handle 2 is released from the receiving portion (not shown) of the stationary frame element or main body of the box. This permits the door 30 (shown in dotted lines in FIG. 4) to be released from the above-mentioned receiving portion of the main body of the box. Consequently, any eligible person or user is capable of opening the door 30 by simply pulling the handle 2 forward relative to the base body 1.

When the predetermined unique combination of the marks for unlocking is not established by rotating each of the dial discs 4, the lock plate 5 rotates in the direction of the arrow as shown in FIG. 14 to lock the combination lock 6. Due to this, the lock plate 5 has its locking end portion 25 abut against the restriction portion of the slider 21 to prevent the receiver lever 16 from turning upward on the first pivot 17 toward its escape position.

Figure 9:
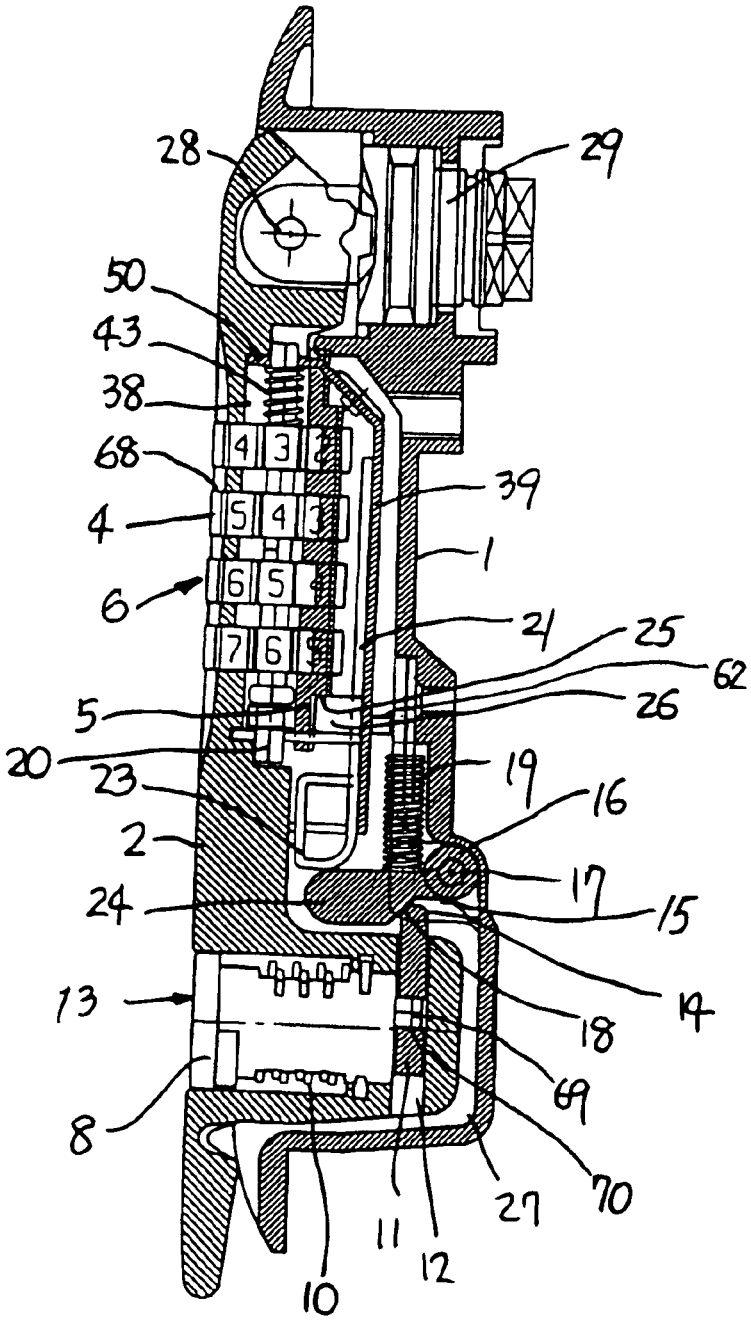
FIG. 9 is a schematic longitudinal sectional view of the door locking handle assembly show in FIG. 8, illustrates the door handle prevented from being pulled out of the base body even when an external force for pulling the door handle out of the base body is applied to the door handle.

In this locked condition of the combination lock 6, when the handle 2 is forcibly pulled forward out of the base body 1, as shown in FIG. 9, the handle 2 is very slightly pulled forward relative to the base body 1 to have immediately the upper end portion 14 of the stopping plate 11 abut against the cam slope 18 of the receiving lever 16, so that such a forcible forward pulling operation of the handle 2 is inhibited by the stopping plate 11.

For example, the control operator of the instruments housed in the box, who allocates to each of the users or persons the predetermined unique combination of marks for unlocking of the dial discs 4, has a broader control power than does each of the users or persons. Consequently, the control operator is capable of pulling forward and turning sideward the handle 2 to open the door 30 without using the combination of the marks for unlocking of the dial discs 4. Furthermore, the control operator is authorized to have the eligible key 7 of the cylinder lock 13.

Figure 10:
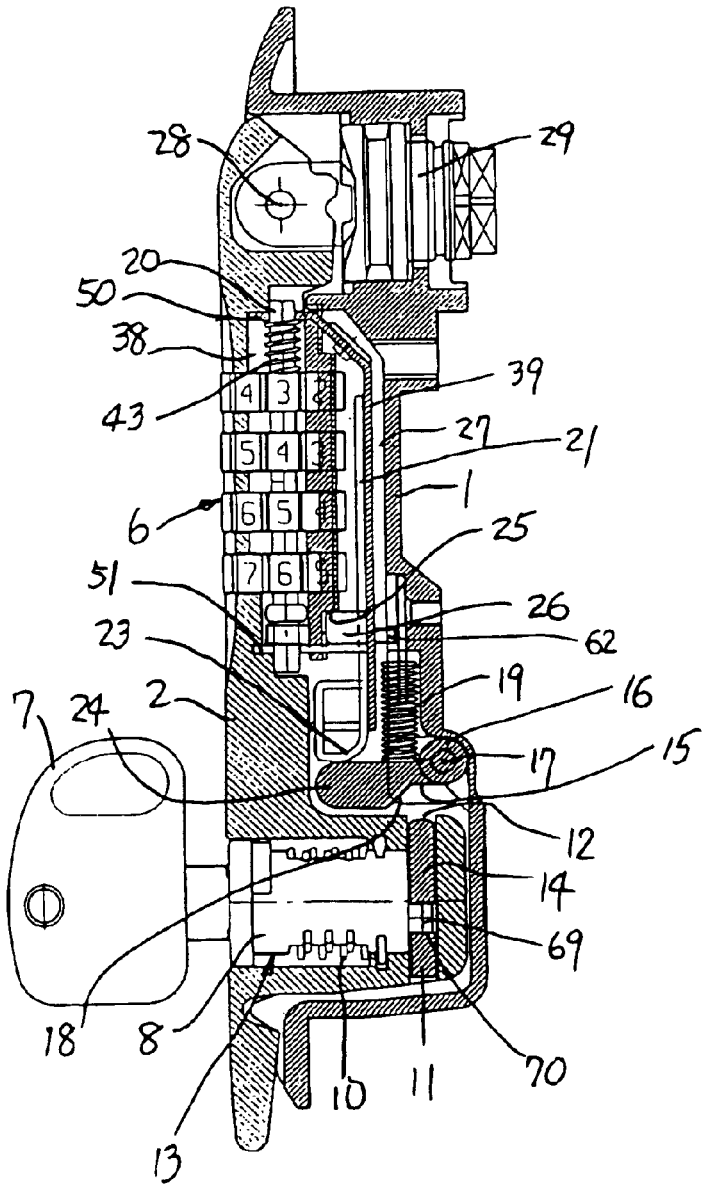
FIG. 10 is a schematic longitudinal sectional view of the door locking handle assembly shown in FIG. 8, illustrating the key inserted into the cylinder lock for rearrangement or resetting of the dial discs when these dial discs are improperly arranged.

As shown in FIG. 10, when an illegal person, who is not authorized to use the box closed with the door 30, illegally operates or turns each of the dial discs 4 of the combination lock 6 to lock the combination lock 6 by accident, it is possible for the control operator to reset the combination lock 6 thus accidentally locked by the illegal person.

In a preliminary stage of the above-mentioned setting operation of the combination lock 6, the control operator inserts the key 7 into the keyhole 9 (shown in FIG. 1) of the rotor 8 in the cylinder lock 13 to unlock the internal lock mechanism 10 of the cylinder lock 13 by using a predetermined coded key ridge portion of the key 7. This makes it possible for the rotor 8 of the cylinder lock 13 to rotate on its longitudinal center axis. When the key 7 thus inserted into the keyhole 9 of the rotor 8 is turned in the unlocking direction of the cylinder lock 13, the stopping plate 11 having been projected from the side through-hole 12 of the handle 2 is retracted from the outside of the handle 2 to entirely received inside the side through-hole 12, so that the upper end portion 14 of the stopping plate 11 is disengaged from the shoulder portion 15 of the receiver lever 16.

As described above, in the locking condition of the combination lock 6, since the locking end portion 25 of the lock plate 5 is in a position in which the locking end portion 25 abuts against the restriction portion 26 of the slider 21, the slider 21 is prevented from moving upward by means of the lock plate 5. As a result, the receiver lever 16 is prevented from turning on the first pivot 17 in its unlocking direction.

Figure 11:
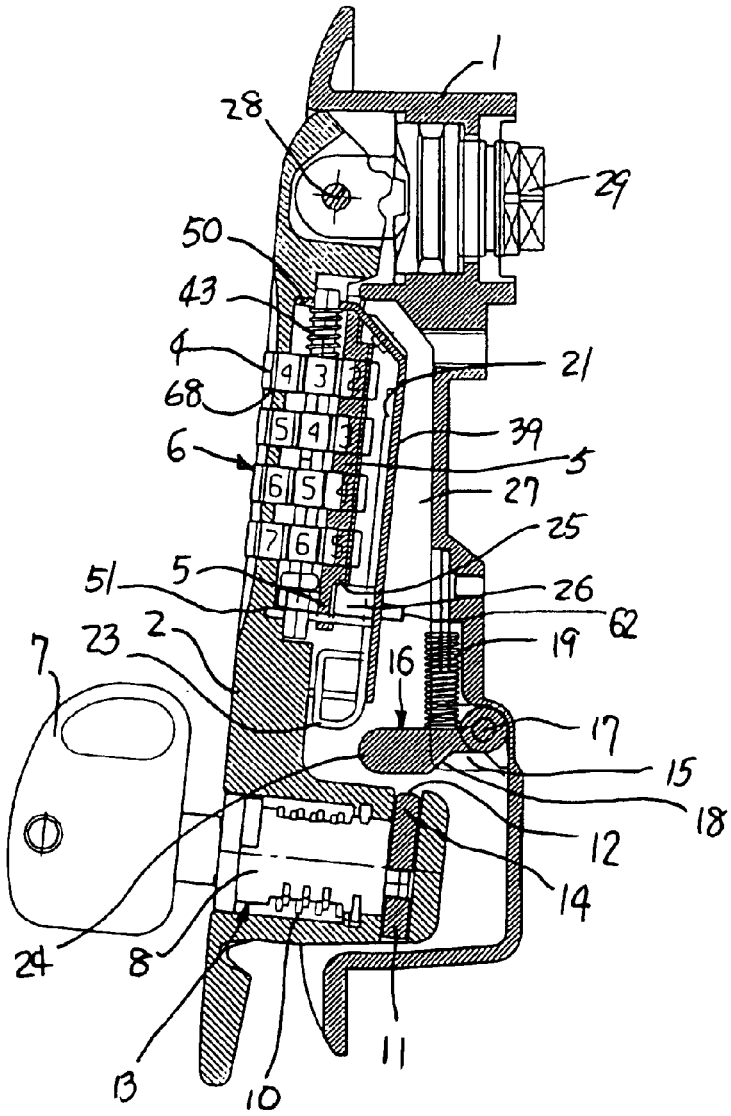
FIG. 11 is a schematic longitudinal sectional view of the door locking handle assembly shown in FIG. 10, illustrating the door handle slightly pulled out of the base body.
Figure 12:
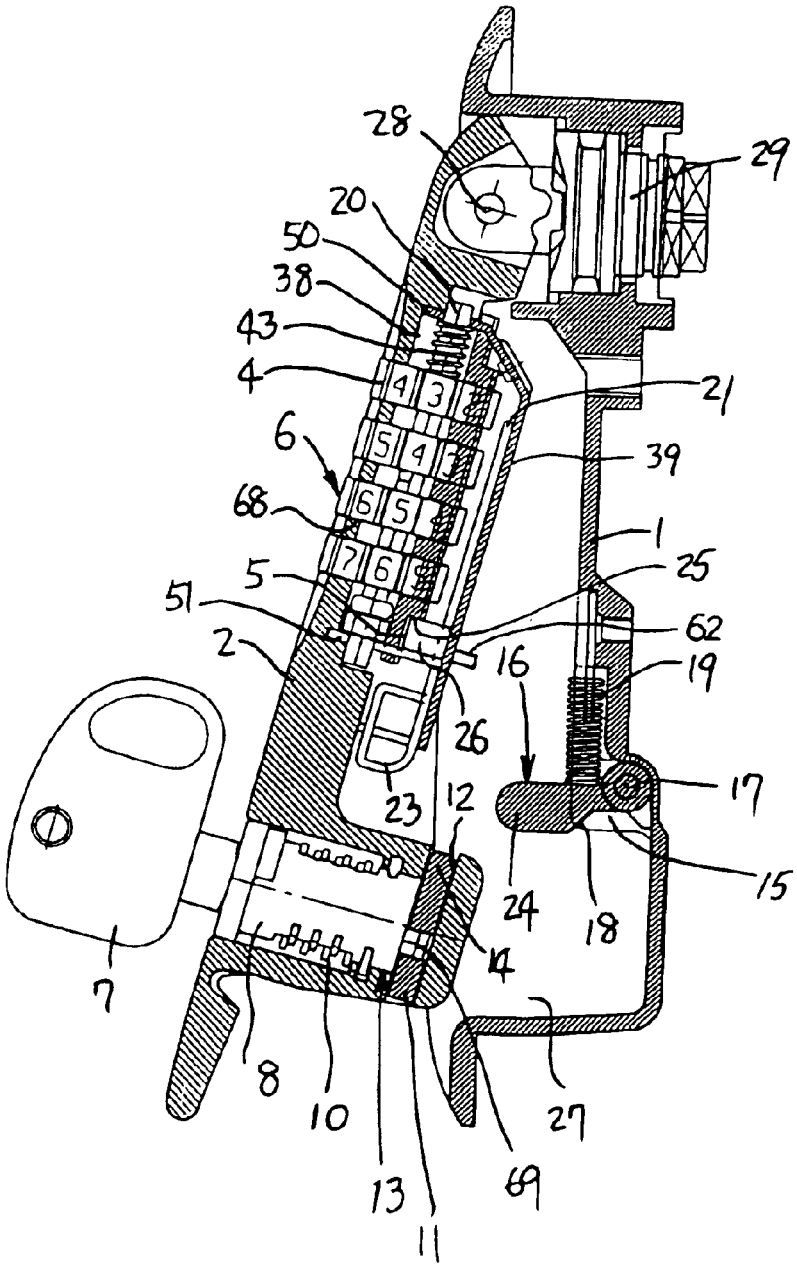
FIG. 12 is a schematic longitudinal sectional view of the door locking handle assembly shown in FIG. 10, illustrating the door handle further apart from the base body than in FIG. 11.

On the other hand, when the cylinder lock 13 is unlocked using the key 7, the stopping plate 11 is entirely retracted from the outside of the handle 2. Therefore, there is no fear that the stopping plate 11 hits the receiver lever 16. Due to this, as is clear from FIGS. 11 and 12, it is possible to pull the handle 2 forward out of the front concave portion 27 of the base body 1 without any interference between the handle 2 and the receiver lever 16.

After the door 30 of the box (not shown) is opened, an appropriate reset means such as a reset lever 62 (shown in FIG. 24) is operated from behind the thus opened door 30 so that the combination lock 6 is released from such an accidental locking condition.

Figure 26:
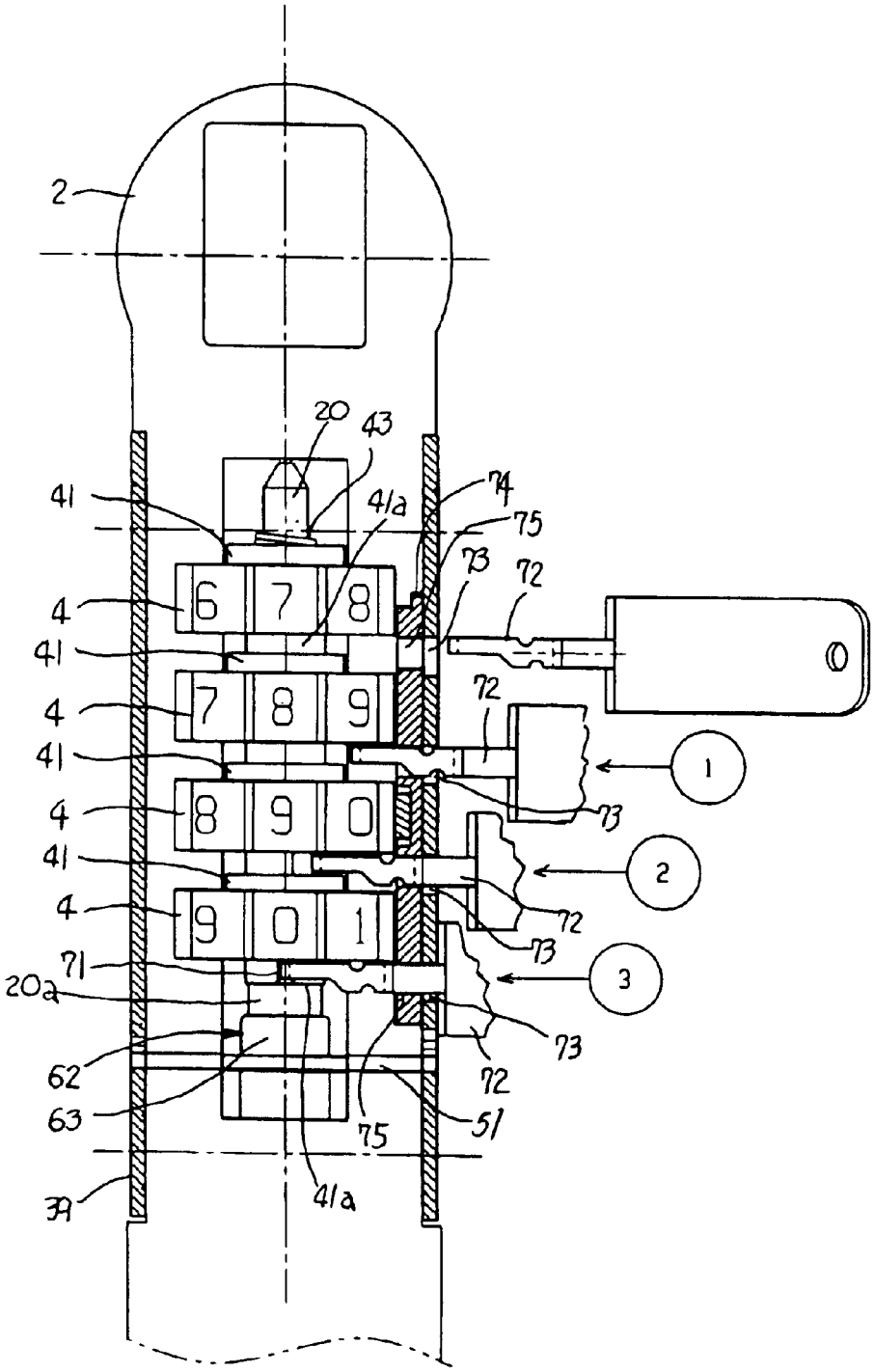
FIG. 26 is a longitudinal sectional view of the combination lock, taken along the line I—I of FIG. 25.
Figure 27:
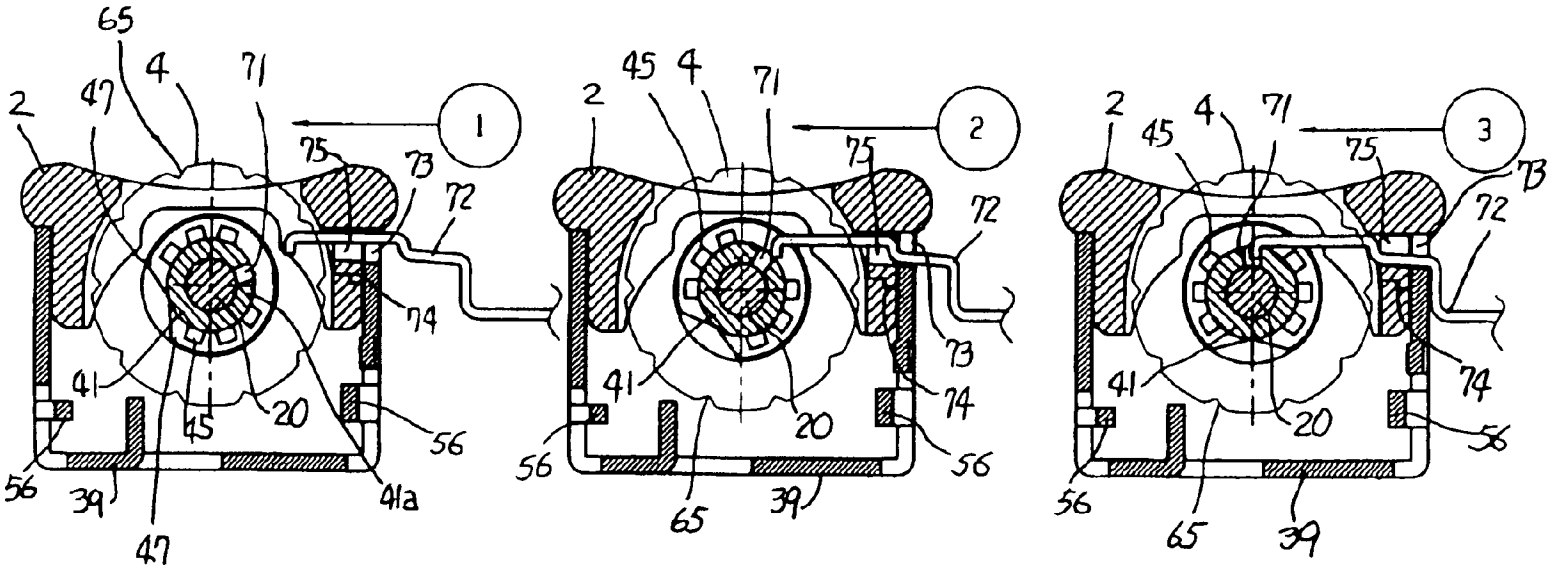
FIG. 27 is a cross-sectional view of combination lock for explaining the detecting process of a predetermined combination of marks for unlocking by a resetting member, which is forgot by the user.
Figure 28:
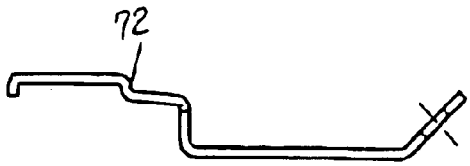
FIG. 28 is a left side view of the resetting member of FIG. 27.

A supervisor having a higher authority than a usual user inserts the resetting member 72 into the combination lock 6 through the opening 75 at a given direction and depth (namely, a first step (1) as shown in FIG. 26 and FIG. 27), when the user cannot operate the combination lock because the user forgot the predetermined combination of marks for unlocking. Then, a leading end of the resetting member 72 is brought into contact with the peripheral surface of the cam disc 41 (namely, a second step (2) as shown in FIG. 26 and FIG. 27). The marked dial disc 4 is rotated or turned with keeping the resetting member 72 at a constant insertion position, and the leading end of the resetting member 72 is brought into engagement with the detecting groove 71 of the cam disc 41 (namely, a third step (3) as shown in FIG. 26 and FIG. 27). The supervisor memorizes or records, as a predetermined mark for unlocking, the mark that is indicated in a mark indication portion of the handle 2 when an engagement of the resetting member 72 and the detecting groove 71 is accomplished.

The above series of the step (1), the step (2) and the step (3) are put into practice for each of the marked dial discs 4, and thereby, a predetermined mark for unlocking is detected and confirmed for each of marked dial discs 4. Then, a predetermined combination of marks for unlocking, which was originally set up at the start of using the door locking handle assembly, can be gotten by arranging those predetermined mark for unlocking in consecutive order.

The supervisor notifies the original predetermined combination of marks for unlocking, which was confirmed in such a way, to the ordinary user. Then, the user rotates the marked dial discs (4) clockwise or counterclockwise in accordance with the predetermined combination of marks for unlocking, which is notified by the supervisor.

Figure 2:
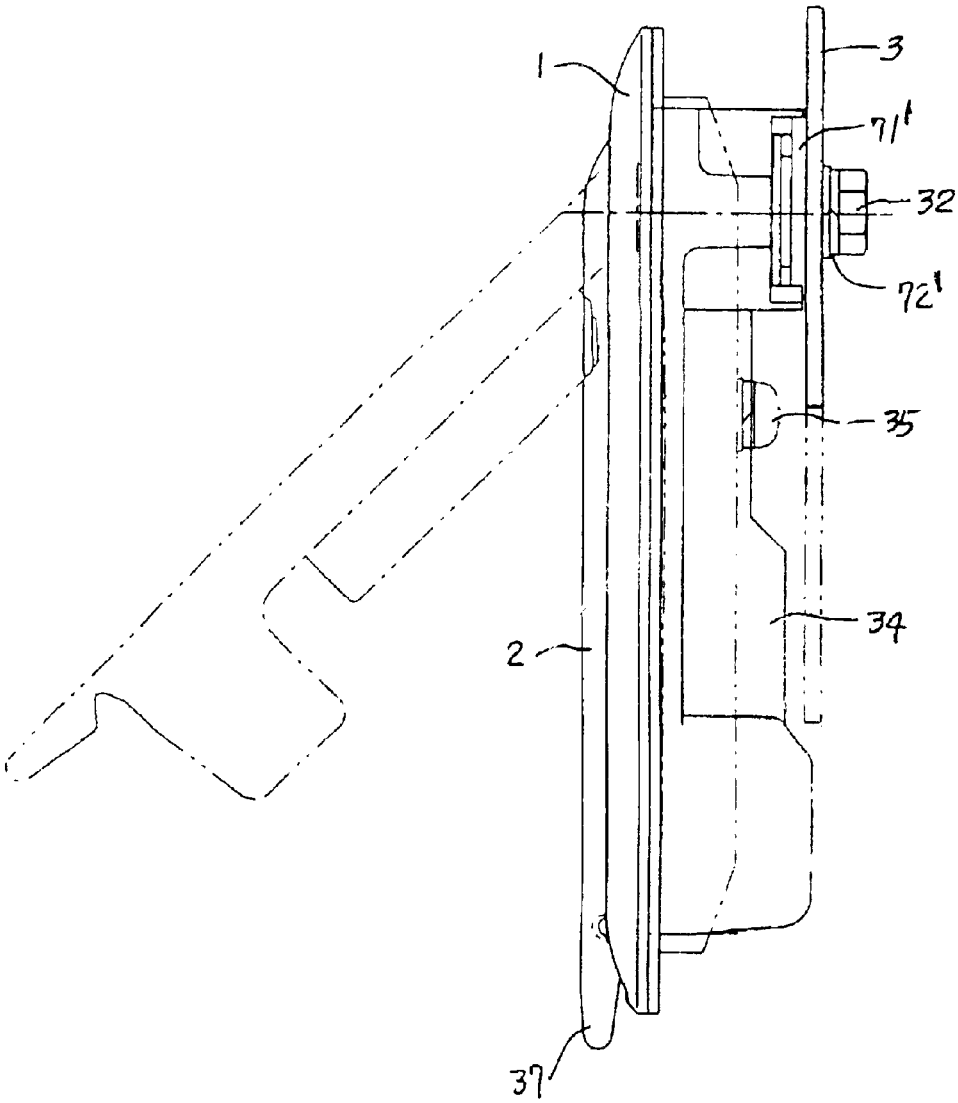
FIG. 2 is a right side view of the door locking handle assembly shown in FIG. 1.
Figure 3:
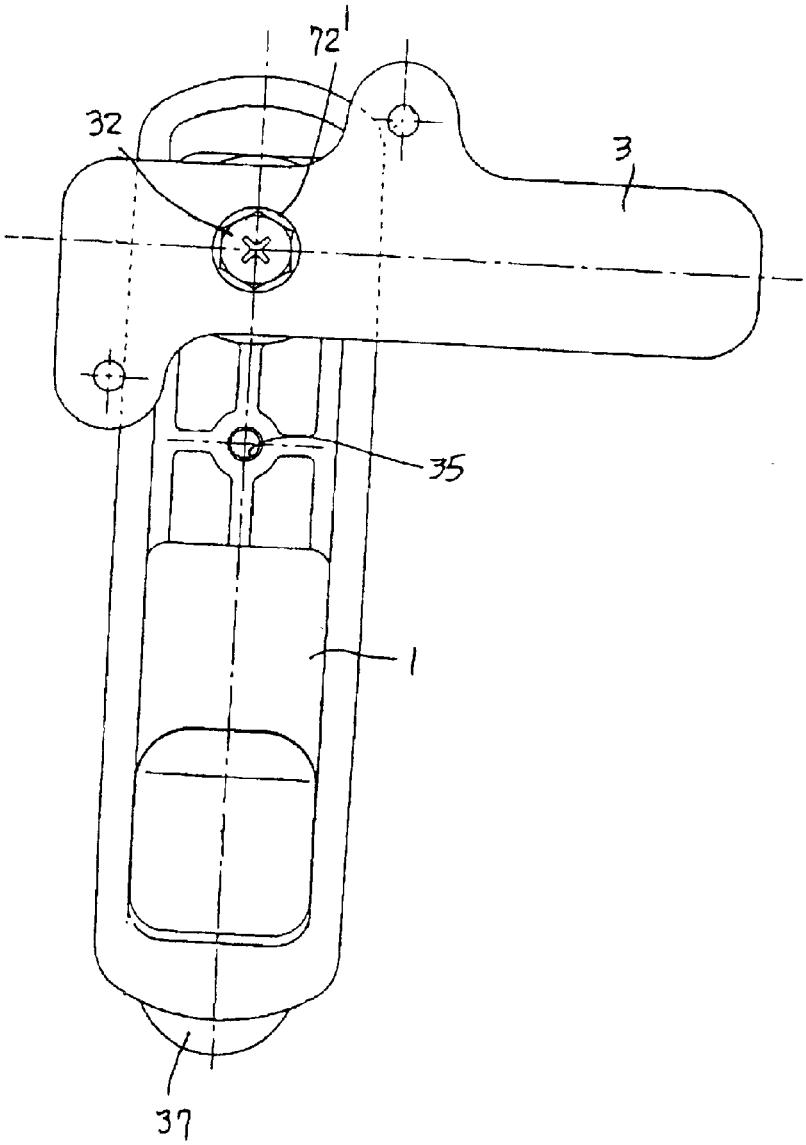
FIG. 3 is a rear view of the door locking handle assembly shown in FIG. 1.

In the embodiment shown in the drawings, as is clear from FIG. 4, a bearing hole 31 is formed in an upper portion of the base body 1 to extend in a direction perpendicular to the plane of the front surface of the door 30. Rotatably received in such a bearing hole 31 of the base body 1 in an insertion manner is a locking shaft 29 which is not axially slidable in the bearing hole 31. The locking shaft 29 is provided with a square-column portion 29*a* in its rear end portion. As shown in FIG. 2, all the locking member 3, a swing-angle limiting plate 71' and a washer 72' are mounted on the rear end square-column portion 29*a* of the locking shaft 29 in an insertion manner. Then, a bolt 32 is threadably connected with a threaded hole (not shown) of a rear end surface of the square-column portion 29*a* of the locking shaft 29, and then tightened in the threaded hole of the locking shaft 29, so that the locking member 3 and the swing-angle limiting plate 71' are fixed to the square-column portion 29*a* of the locking shaft 29 through the washer 72'. The base body 1 is mounted in an elongated front receiving hole 32 of the door 30 from the front side of the door 30 in an insertion manner. On the other hand, a mounting plate 34 assuming a U-shaped form in cross section is mounted on a rear surface of the door 30 to mate with the base body 1, and then fixed to the door 30 by means of a suitable fastening means such as a screw 35 or the like, as shown in FIGS. 2 and 3.

As shown in FIG. 4, formed in an upper rear portion of the handle 2 is a concave portion 36. This concave portion 36 assumes a substantially fan-like shape in longitudinal section to swingably receive therein a front end portion of the locking shaft 29. More specifically, the handle 2 had its upper end portion corresponding to its concave portion 36 pivoted to the front end portion of the locking shaft 29 through a second pivot or cross pivot 28. This cross pivot 28 extends in parallel with a front surface of the door 30 in a direction perpendicular to the longitudinal axis of the handle 2. In operation, when the handle 2 is folded down so as to be embedded in the base body 1, it is possible for the front concave portion 27 of the base body 1 to receive therein a rear portion of an essential part of the handle 2. As shown in FIG. 3, formed in a lower end portion of the handle 2 is a flange 37 serving as a fingertip engaging edge portion of flange 37, which bulges out downward in the longitudinal direction of the handle 2. As is clear from FIG. 4, even when the handle 2 is in its folded position, the fingertip engaging edge portion of flange 37 of the handle 2 is still spaced apart forward from a front surface of the corresponding lower portion of the base body 1, which enables the person or user to pick up the lower free end portion of the handle 2 in an easy manner.

Figure 7:
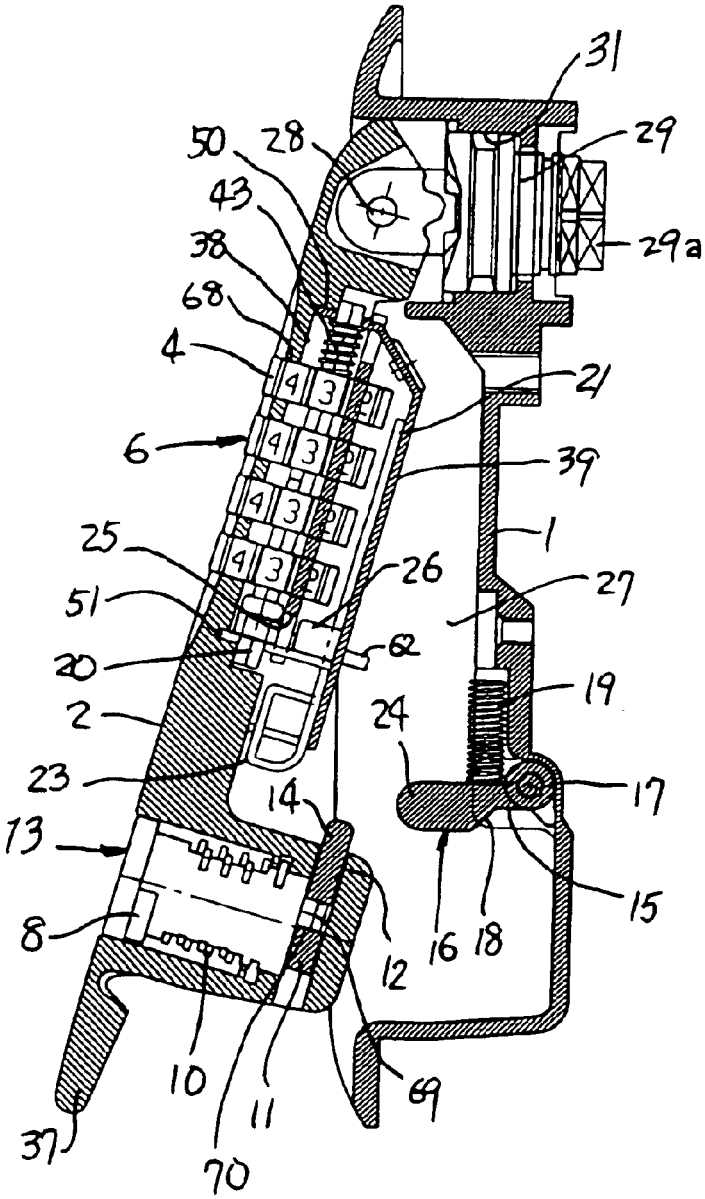
FIG. 7 is a schematic longitudinal sectional view of the door locking handle assembly shown in FIG. 4, illustrating the door handle still further apart from the base body than in FIG. 6.
Figure 8:
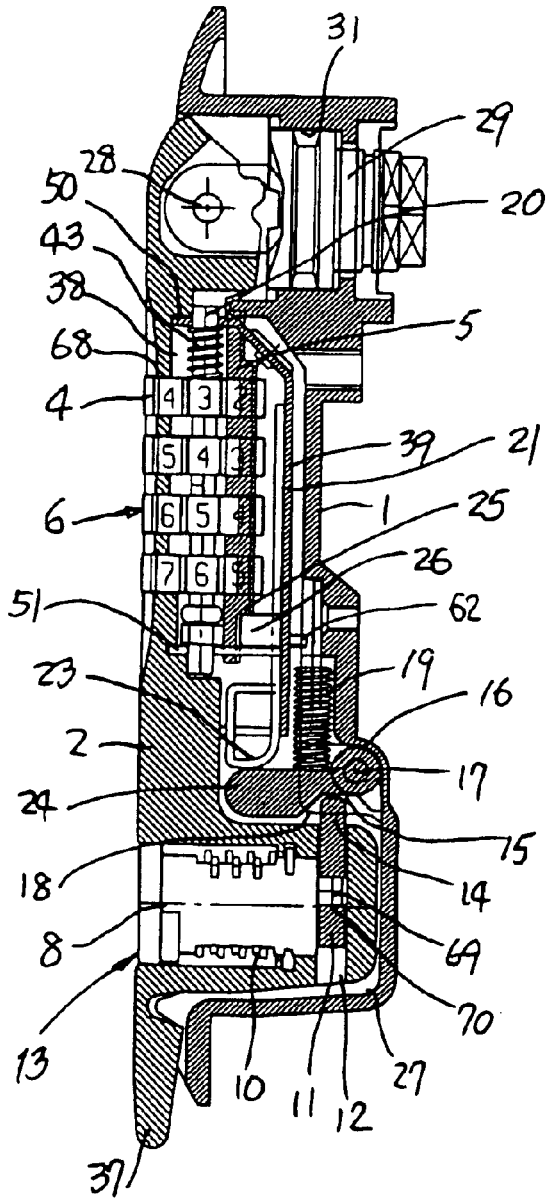
FIG. 8 is a schematic longitudinal sectional view of the door locking handle assembly in a condition in which the unique combination of the marks of the dial discs is not established.

On the other hand, when the handle 2 is in its raised position in which the handle 2 is inclined forward as viewed in FIG. 7, it is possible for the user or person to swing sideward or turn the handle 2 on the locking shaft 29 together with this locking shaft 29 relative to the base body 1.

Formed in an intermediate portion of the handle 2 to extend in the longitudinal direction of the handle 2 is an elongated hollow portion 38 for receiving therein a combination lock 6. The hollow portion 38 of the handle 2 is open at the rear side of the handle 2 to form an opening which is covered by a back plate member 39, as shown in FIG. 7.

As is clear from FIGS. 13 to 24, the combination lock 6 is constructed of a plurality of its components. Essential ones of these components of the combination lock 6 are: a plurality of the marked dial discs 4; a plurality of cam discs 41, each of which has a part thereof inserted into a center through-hole of the dial disc 4 and stacked together into a neat pile; the center pin 20, which assumes the same shape as that of a round bar and inserted into a center hole 42 of each of the cam discs 41; a compression coil spring 43 for urging downward such a neat pile consisting of both the dial discs 4 and the cam discs 41 toward the cylinder lock 13; and, the lock plate 5, which is provided with a rectangular opening portion 44 (shown in FIG. 16) to receive therein a part of each of the dial discs 4.

As shown in FIGS. 17 to 22, the center through-hole 40 (shown in FIG. 18 and 19) of the dial disc 4 is constructed of: a small-diameter bore portion 40*a*; and, a pair of large-diameter bore portions 40*b* and 40*c*, sandwiched in between which is the small-diameter bore portion 40*a*. In a normal condition, under the influence of a resilient force exerted by the compression coil spring 43, a small-diameter sleeve portion 41*a*of the cam disc 41, which is inserted into the small-diameter bore portion 40*a* of the dial disc 4 from above, projects downward from the lower large-diameter bore portion 40*c* of the dial disc 4, as is clear from FIG. 24, so that a large-diameter flange portion 41*b* of the cam disc 41 is received in the upper large-diameter bore portion 40*b* of the dial disc 4. At the same time, the large-diameter flange portion 41*b* has its upper end surface abut against a lower end surface of the small-diameter sleeve portion 41*a* of the upper adjacent cam disc 41. As is clear from FIG. 1, a part of the peripheral portion of the dial disc 4 projects forward through a laterally elongated slot 68 formed in a front surface of the handle 2.

Figure 16:
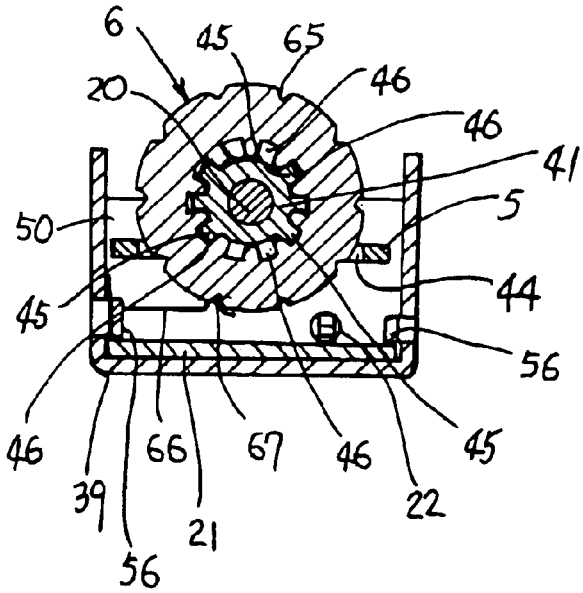
FIG. 16 is a cross-sectional view of combination lock, taken along the line C—C of FIG. 2.
Figure 20:
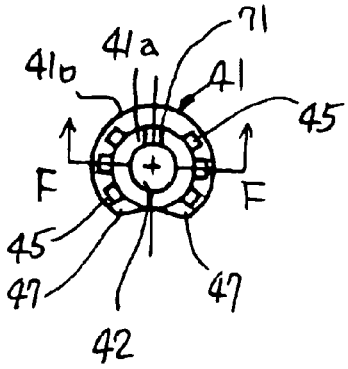
FIG. 20 is a bottom view of the cam disc employed in the combination lock shown in FIG. 2.
Figure 21:
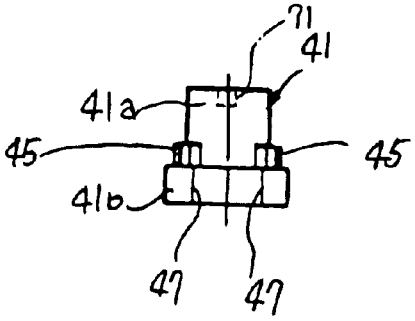
FIG. 21 is a rear view of the cam disc shown in FIG. 20.
Figure 22:
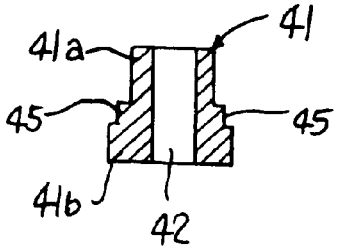
FIG. 22 is a longitudinal sectional view of the cam disc, taken along the line F—F of FIG. 20.

As shown in FIGS. 20 to 22, formed in a peripheral surface of a root portion of the small-diameter sleeve portion 41*a* of the cam disc 41 are a pair of diametrically opposed projection groups, each of which groups contains three piece of equally-spaced interlocking projections 45. On the other hand, as is clear from FIG. 16, formed in an inner peripheral surface of the small-diameter bore portion 40*a* of the dial disc 4 are ten piece of equally-spaced interlocking grooves 46 which corresponds in number to the marks "1" to "10" provided in the outer peripheral surface of the dial disc 4. The dial disc 4 and the corresponding cam disc 41 are combined with each other through engagement established between the interlocking projections 45 of the cam disc 41 and the corresponding interlocking grooves 46 of the dial disc 4, as shown in FIG. 16.

In order to change the allocated predetermined combination of the marks for unlocking in the combination lock 6, it is necessary to slide or displace the cam disc 41 upward by a distance equal to an axial length of the interlocking groove 46. Such an axial displacement of the cam disc 41 relative to the adjacent one of the dial discs 4 makes it possible for the cam disc 41 to have its interlocking projections 45 disengaged from the corresponding interlocking grooves 46 of the dial disc 4. After that, the cam disc 41 is rotated on its center axis relative to the dial disc 4 by a predetermined angle which is equal to an integral multiple of the interval between adjacent ones of the interlocking grooves 46. Then, the thus rotated cam disc 41 is returned or displaced downward to its initial level or height. As a result, the combination of marks of the dial disc 4 is changed to a new unique combination of the marks in the combination lock 6.

Figure 13:
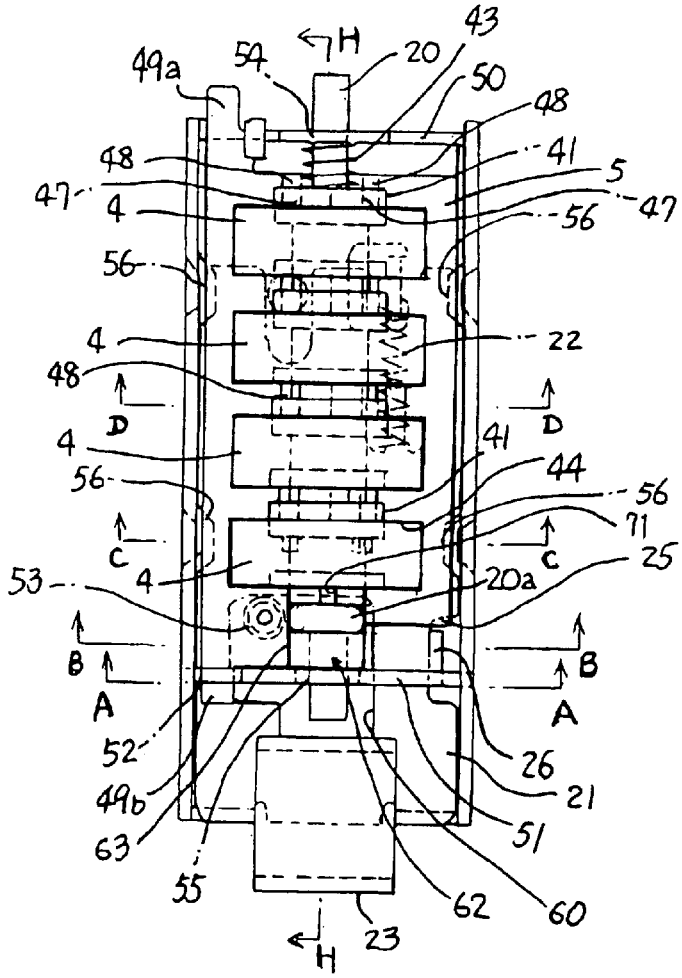
FIG. 13 is a front view of the built-in combination lock of the door locking handle assembly shown in FIG. 1, illustrating the dial discs the marks of which are not shown together with the positioning grooves of these marks.

As is clear from FIG. 20, an outer peripheral portion of the large-diameter flange portion 41*b* of the cam disc 41 is partially cut off to form a pair of V-shaped notch portions 47 which are adjacent to each other to form a large-angle notch in appearance. As is clear from FIG. 17, the lock plate 5 is provided with a pair of V-shaped receiving grooves 48 in cross section. As shown in FIG. 13, these grooves 48 of the lock plate 5 are formed in a bridge portion between adjacent ones of the rectangular opening portions 44 of the lock plate 5 and correspond, in position and contour, to the V-shaped notch portions 47 of the cam disc 41. When the V-shaped notch portions 47 of the cam disc 41 engage with the rectangular opening portions 44 of the lock plate 5, the lock plate 5 is in a position in which the locking end portion 25 of the lock plate 5 is free from the restriction portion 26 of the slider 21, as shown in FIG. 15. When the V-shaped notch portions 47 of the cam disc 41 are disengaged from the rectangular opening portions 44 of the lock plate 5, a crest portion of the lock plate 48 in cross section between its V-shaped receiving grooves 48 abuts against the circular outer peripheral surface of the large-diameter flange portion 41*b* of the cam disc 41. This permits the lock plate 5 to rotate on its center axis to one of its angular positions, in which one the locking end portion 25 of the lock plate 5 abuts against is the restriction portion 26 of the slider 21.

As shown in FIG. 13, an upper support projection 49*a* and a lower support projection 49*b* are formed in an upper end portion and a lower end portion of the lock plate 5, respectively. Further, as is clear from FIG. 13, the lock plate 5 has its support projections 49*a*, 49*b* oppositely disposed from its locking end portion 25. The upper support projection 49*a* is supported by an upright wall plate portion 50 of the back plate member 39. On the other hand, the lower support projection 49*b* is supported in a through-hole 52 (shown in dotted lines in FIG. 13) of a partition wall plate 51 which is fixedly mounted on the back plate member 39. As shown in FIG. 15, the lock plate 5 is resiliently urged forward by means of a compression coil spring 53 to prevent its locking end portion 25 from abutting against the restriction portion 26 of the slider 21.

Figure 24:
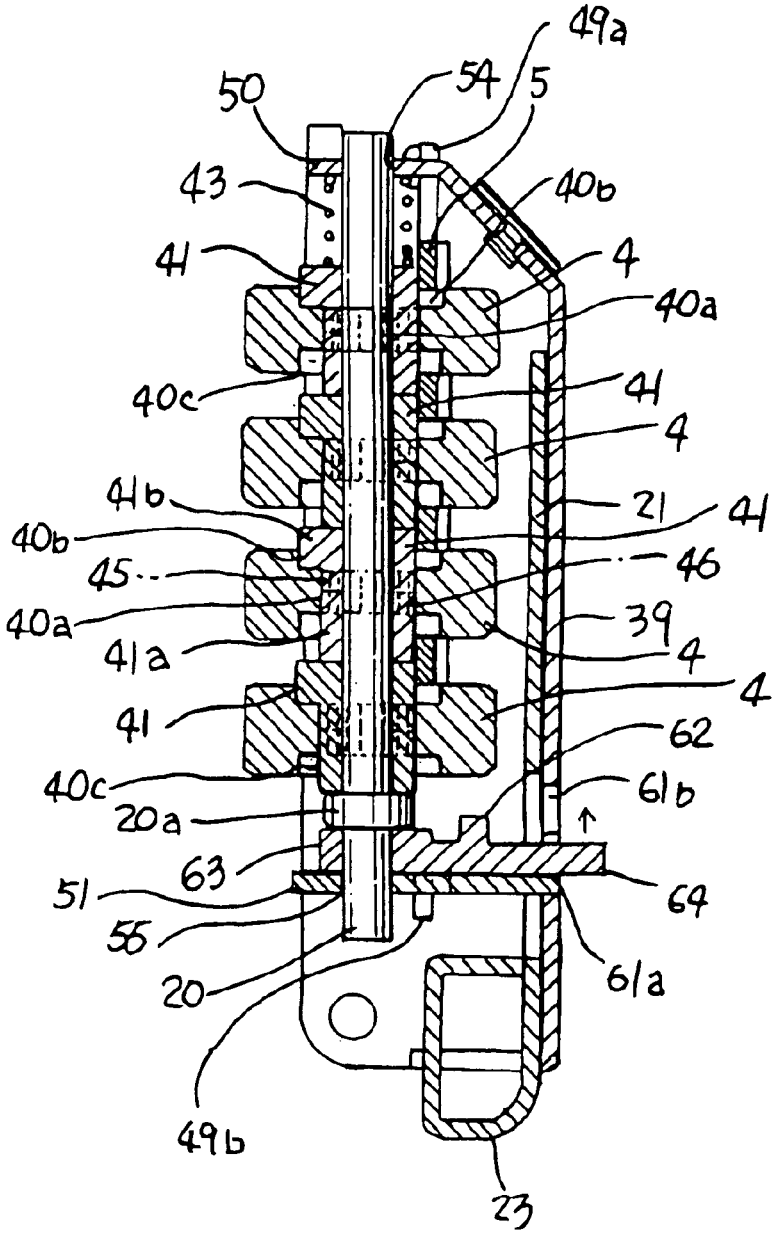
FIG. 24 is a longitudinal sectional view of the combination lock, taken along the line H—H of FIG. 13.

As shown in FIG. 24, the center pin 20 of the combination lock 6 has its upper and its lower end portion inserted into an upper pin hole 54 and a lower pin hole 55, respectively, wherein: the upper pin hole 54 is formed in the upright wall plate portion 50 of the back plate member 39; and, the lower pin hole 55 is formed in the partition wall plate 51. On the other hand, the compression coil spring 43 for urging downward both the dial discs 4 and the cam discs 41 is loosely mounted on the upper end portion of the center pin 20 and compressed between the uppermost one of the cam discs 41 and the upright wall plate portion 50, as is clear from FIG. 24.

Figure 23:
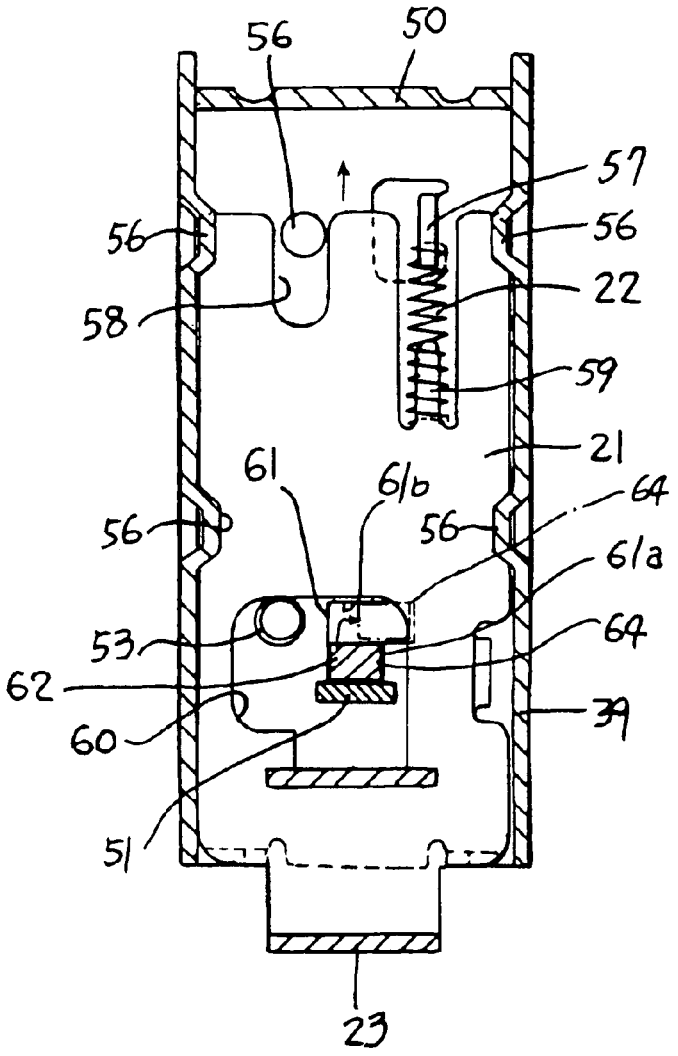
FIG. 23 is a longitudinal section view of the combination lock, taken along the line G—G of FIG. 14.

The slider 21 is constructed of a plate member and capable of sliding along the back plate 39. As is clear from FIGS. 16 and 23, a plurality of inner guide projections 56 are formed in both a main body and a pair of opposite side portions of the back plate 39 to extend inside the back plate 39 to slidably guide the slider 21. Also formed in the back plate 39 is a first spring support projection 57, which cooperates with a second spring support projection 59 of the slider 21 to support the compression coil spring or second spring member 22 therebetween. The second spring member 22 is used to urge the slider 21 downward toward the receiver lever 16. Further, as shown in FIG. 23, the slider 21 is provided with a guide groove 58 which receives therein the guide projection 56 of the back plate 39.

As shown in FIG. 4, the first pivot 17 of the receiver lever 16 extends in parallel with the front surface of the door 30. On the other hand, the slider 21 is provided with an escape opening 60 for preventing both the compression coil spring 53 and the partition wall plate 51 from interfering with the slider 21 in operation. As is clear from FIG. 23, an L-shaped opening 61 is formed in the back plate 39 oppositely disposed from the slider 21.

As shown in FIG. 24, the center pin 20 of the combination lock 6 is provided with a flange portion 20*a* which abuts against the lowermost one of the cam discs 41. The reset lever 62 has its proximal end ring portion 63 rotatably mounted on the center pin 20 in a position between the flange portion 20*a* and the partition wall plate 51. On the other hand, in a normal condition, a grip portion 64 of the reset lever 62 passes through a vertical portion 61*a* of the L-shaped opening 61 of the back plate 39, as shown in FIGS. 23 and 24.

In order to perform the resetting operation or the changing operation of the predetermined combination of the marks for unlocking in the combination lock 6, it is necessary for the user to grip and push upward the grip portion 64 of the reset lever 62. As is clear from FIG. 24, the grip portion 64 of the reset lever 62 projects rearward beyond the back plate 39 through its L-shaped opening 61 to facilitate such a pushing-up operation of the reset lever 62. When the reset lever 62 is thus pushed up, the pile of the cam discs 41 is pushed up toward the locking shaft 29 in a manner such that the interlocking projections 45 of the cam discs 41 are disengaged from the corresponding interlocking grooves 46 of the dial discs 4. In order to keep the pile of the cam discs 41 in their pushed-up position, it is necessary for the user to slightly tilt the reset lever 62 in a manner such that the grip portion 64 of the reset lever 62 is engaged with a lateral portion 61*b* of the L-shaped opening 61.

After turning each of the dial discs 4 in a normal or a reverse direction a desired number of times, the cam discs 41 have their interlocking projections 45 engaged with the corresponding interlocking grooves 46 of the dial discs 4 to determine a new combination of the marks of the dial discs 4, wherein such a new combination differs from the previous combination of the marks of the dial discs 4.

Figure 17:
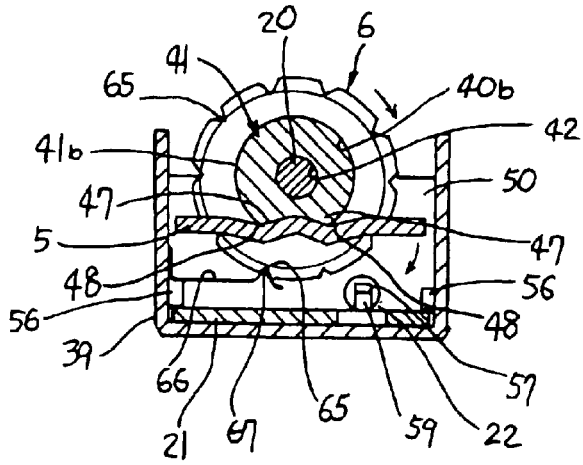
FIG. 17 is a cross-sectional view of combination lock, taken along the line D—D of FIG. 2.
Figure 18:
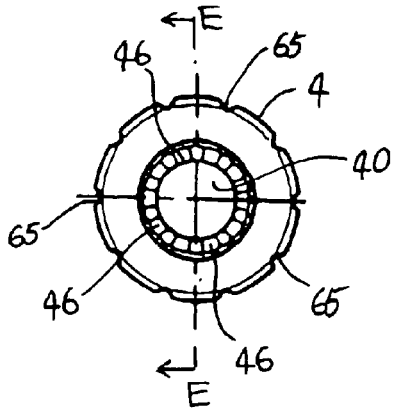
FIG. 18 is a plan view of the dial disc employed in the combination lock shown in FIG. 2.
Figure 19:
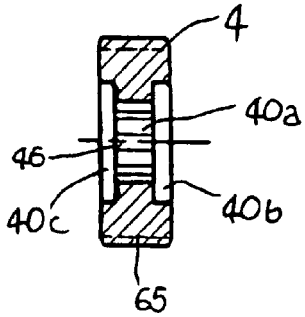
FIG. 19 is a longitudinal sectional view of the dial disc, taken along the line E—E of FIG. 18.

In the outer peripheral surface of each of the cam discs 4, there are formed a plurality of positioning grooves 65 at predetermined intervals. The number of these positioning grooves 65 of the cam disc 4 is the same as that of the marks of the dial disc 4. On the other hand, as shown in FIG. 17, a third spring member 66 for keeping the dial discs 4 in their desired angular positions is fixedly mounted on the side wall portion of the back plate member 39 in a manner such that the third spring member 66 has its front end projections 67 resiliently engaged with the corresponding positioning grooves 65 of the cam discs 4.

As the internal lock mechanism 10 of the cylinder lock 13, there is used a conventional disc tumbler lock mechanism in which: as shown in FIG. 4, an eccentric cam projection 69 formed in a rear end surface of the rotor 8 of the cylinder lock 13 is slidably received in a laterally elongated slot 70 formed in the proximal end portion of the stopping plate 11.

As an example of the internal lock mechanism 10, there is a pin tumbler lock mechanism or the like which is capable of being employed in the door locking handle assembly of the present invention.

Figure 25:
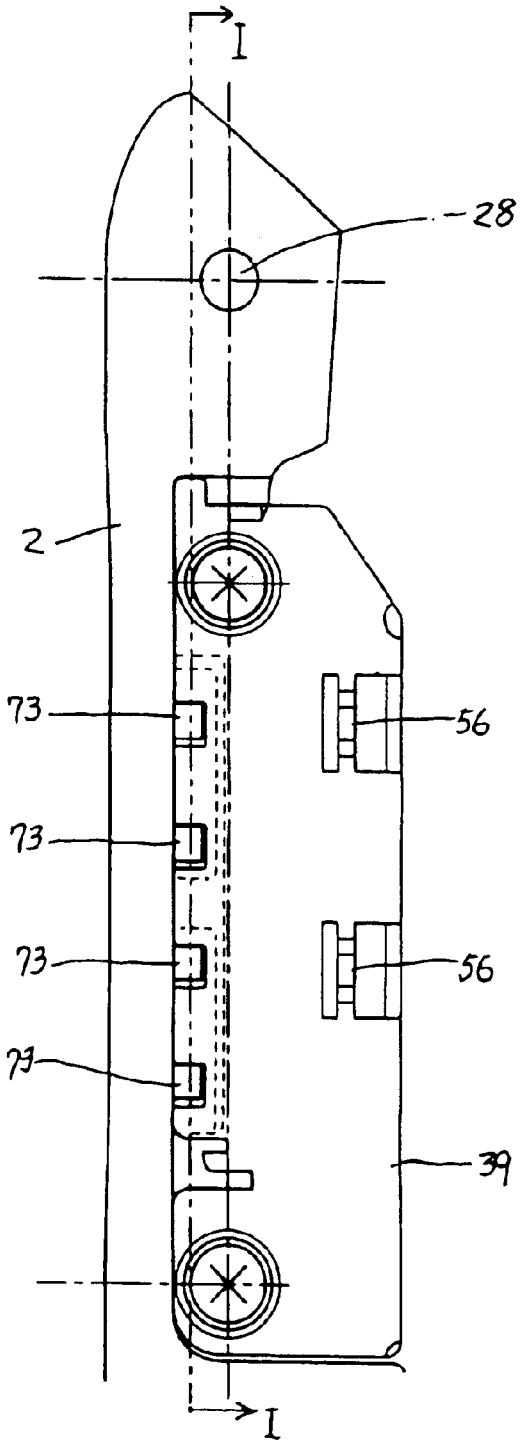
FIG. 25 is a partial right side view of a door handle employed in the door locking handle assembly shown in FIG. 1.

In an example of the invention of claim 3, as shown in FIGS. 25 and 26 the detecting groove 71 is formed on the small-diameter sleeve portion 41*a* of the cam disc 41, and the opening 75 for the resetting member 72 is formed on a side wall portion 74 of the handle 2. A plurality of another openings 73 are formed on a upright wall portion of the back plate 39, which covers the side wall portion 74 of the handle 2. The opening fronts the opening 75. The resetting member 72 is composed of a strip main body and a gripping portion. The leading end portion of the resetting member 72, which engages with the detecting groove 71, is bent downward.

When a pair of V-shaped projections 47,47 of the large-diameter flange portion 41*b* engage with a pair of V-shaped receiving grooves 48 of the locking plate 5, the cam disc 41 comes to the position or level wherein the locking end portion 25 disengages with the restriction portion 26 of the slider 21, and the combination lock 6 is set in its unlocked condition. The detecting groove 71 of the cam disc 41 is formed on such position that the leading end portion of the resetting member 72 can engages with it, when the resetting member 72 is inserted through the opening 75 in said unlocked condition.

Changing of the predetermined combination of marks for unlocking is conducted by moving the cam disc 41 at a longitudinal length of the interlocking groove 46 along the center pin 20 so that the interlocking groove 46 of the dial disc 4 disengages from the interlocking projection 45 of the cam disc 41, and then by rotating the cam disc 41 relatively at an angle of integral times of disposition interval of the interlocking grooves 46, and then by moving back the cam disc 41 to the dial disc 4. At this stage, the mark of the marked dial disc 4, which is indicated in a central area of the oblong slot 68 of the handle 2, is a predetermined mark for unlocking. The oblong slot 68 is a mark indication portion. Thereafter, each of the marked dial discs 4 is rotated at random so that the predetermined combination of marks for unlocking may not be known to the other persons. Thus, the combination lock 6 is prevented from being illegally unlocked.

Accordingly, when a due user unlocks the combination lock 6, the user rotates each of the marked dial discs 4 until each of the predetermined marks for unlocking is indicated in the mark indication portions 68 of handle 2 clockwise or counterclockwise. When all of the predetermined marks for unlocking are indicated in the mark indication portion 68, all of the detecting groove 71 of the cam discs 41 have faced to the opening 75 of the door handle 2.

Therefore, if the user forgot the predetermined combination of marks for unlocking, which is allotted for the user, the user can detect and confirm the predetermined combination of marks for unlocking by rotating the marked dial disc 4 and the cam disc 41 as a whole, and by engaging the resetting member 72 with the detecting groove 71.

In order to keep the insertion direction of the resetting member 72 and the insertion depth of the resetting member 72 constant, the resetting member 72 is inserted into the openings 73,75 with contacting it to the one of side wall surfaces of the openings 73,75. When the marked dial discs 4 are rotated, the bent leading end portion of the resetting member 72 is pressed on the peripheral surface of the small-diameter sleeve portion 41*a*. The resetting member 72 cannot be limited to the one as shown in the drawings in figure and dimensions. It is possible to select such a figure and dimensions that are arranged so as to access to the peripheral surface of the cam disc 41 with passing through the openings 73,75.

Also, the opening 75 as an accessing passage for the resetting member 72 can be formed on a front wall portion of the handle 2 without forming on the side wall portion 74 of the handle 2. When the opening 75 is formed on the side wall portion 74 of the handle, the side wall portion 74 is concealed or covered by a side wall portion of the base body 1. In order to access to the opening 75, it is necessary to pull the handle 2 outward by unlocking the cylinder lock 13 with its key 7. Accordingly, the predetermined combination of marks for unlocking cannot be known to the other persons, and the security is improved.

In the door locking handle assembly of claim 1 and claim 2 having the above construction: when the predetermined combination of the marks of the dial discs 4 of the combination lock 6 is established, the combination lock 6 is unlocked; the cylinder lock 13 is unlocked using the key 7; the combination lock 6 is incorporated in the door handle 2 together with the cylinder lock 13 in a manner such that these locks 6, 13 are disposed adjacent to each other in the longitudinal direction of the door handle 2; the receiver lever 16 pivoted to the base body 1 is controlled in motion by means of the lock plate 5; the stopper plate 11 which is engaged with and disengaged from the receiver lever 16 is mechanically interlocked with the rotor 8 of the cylinder lock 13 to make it possible to lock and unlock the door handle 2 to and from the base body 1, so that it is possible for the present invention to downsize the door locking handle assembly in thickness as a whole in a condition in which a large number of eligible keys 7 are provided in an easy manner; and, it is possible for the control operator of the various instruments contained in the box or container to control a large number of the users or persons in various control modes through the computerized personal management system without fail.

Further, in the door locking handle assembly of the present invention having the above construction, it is possible to prevent the receiver lever 16 from turning or moving toward its unlocked position by simply having the upper end portion 14 of the stopping plate 11 abut against the cam slope 18 of the receiver lever 16. Due to this, in the door locking handle assembly of the present invention, there is no need for a separate drive mechanism for driving the receiver lever 16. This makes it possible to reduce the number of the components or parts of the door locking handle assembly and therefore possible to simplify the assembly in construction.

In the door locking handle assembly of claim 3, if the user forgot his predetermined combination of marks for unlocking, the user or supervisor can detect and confirm it speedily by such simple operations of contacting the resetting member 72 with the peripheral surface of the cam disc 41 through the opening 75 of the handle 2, and of turning the marked dial disc 4 until the resetting member 72 engages with each of said detecting grooves 71. Thereby, the combination lock 6 can be reset so as to operate again.

What is claimed is:

1. In a door locking handle assembly with a built-in combination lock (6), the assembly being provided with a base body (1) which is fixedly mounted on a door (30) of a box, wherein a handle (2) is pivoted to said base body (1) so as to be capable of being pulled out forward and pushed back rearward relative to said base body (1) and also turning sideward on a locking shaft (20) after completion of its pulling-out operation, wherein a locking member (3) serving as a door bolt for locking said door (30) to a main body of said box is directly or indirectly connected with said handle (2) so as to be engaged with and disengaged from a receiving portion of a stationary frame element when said handle (2) is pulled out forward and then turned sideward on said locking shaft (20) after completion of the pulling-out operation of said handle (2), the improvement wherein:

said combination lock (6), which is provided with a plurality of marked dial discs (4), is incorporated in said handle (2) and opened by turning each of said marked dial discs (4) a given number of times to establish a predetermined combination of marks for unlocking, which marks are provided in outer peripheral surfaces of said dial discs (4);

said combination lock (6) is held in its locked condition, when said predetermined combination of marks for unlocking of said dial discs (4) is not established;

a cylinder lock (13) is incorporated in said handle (2) and disposed adjacent to said combination lock (6) in a longitudinal direction of said handle (2), wherein said cylinder lock (13) is provided with a rotor (8);

when a key (7) is inserted into a keyhole (9) of said rotor (8) of said cylinder lock (13), said cylinder lock (13) has its internal lock mechanism (10) unlocked to permit said rotor (8) to be turned by said key (7) thus inserted into said keyhole (9) of said rotor (8); and an intermediate actuating member is disposed between the combination lock (6) and the cylinder lock (13) in such a manner that the handle 2 can be pulled out forward relative to said base body (1), when the combination lock (6) is brought into its unlock condition under the circumstances wherein the cylinder lock (13) is held in its lock condition, or, when the cylinder lock (13) is brought into unlock condition under the circumstances wherein the combination lock (6) is held in its lock condition.

2. The door locking handle assembly with a built-in combination as set forth in claim 1, wherein:

said combination lock (6) is constructed in such a manner that a locking plate (5) is brought into its unlocked position, when a plurality of marked dial discs (4) is rotated so as to establish said predetermined combination of marks for unlocking, which marks are provided in outer peripheral surfaces of said marked dial discs (4), while the locking plate (5) is held in its locked position when said predetermined combination of marks for unlocking is not established;

said cylinder lock (13) is constructed in such a manner that its internal lock mechanism (10) is brought into its unlocked by inserting the key (7) into the keyhole (9) of said rotor, and then a stopping plate (11) is projected outward and retracted inward through a side hole (12) of said handle (2);

said intermediate actuating member is constructed by a receiver lever (16) which has its proximal end portion pivoted to an inner wall portion of said base body (1) through a pivot (17);

said stopping plate (11) has its upper end portion (14) abut against a shoulder portion (15) of a lower surface of a proximal end portion of said receiver lever (16);

said shoulder portion (15) of said receiver lever (16) is provided with a cam slope (18) through which said receiver lever (16) is pushed upward by said upper end portion of said stopper plate (11);

said receiver lever (16) is urged toward said stopping plate (11) by means of a first spring member (19);

a slider (21) is disposed in parallel with a center pin (20) of said combination lock (6), and urged toward said cylinder lock (13) by means of a second spring member (22) in a manner such that a lower end portion (23) of said slider (21) abuts against an upper surface of said receiver lever (16), so that said slider (21) has its restriction portion (26) engaged with and disengaged from a locking end portion (25) of a locking plate (5) when said lock plate (5) is held in its locked position and its unlocked position, respectively;

when said locking plate (5) is held in its unlocked position, said handle (2) is capable of being pulled forward out of said base body (1);

when said handle (2) is thus pulled out forward, said stopping plate (11) pushes said cam slope (18) of said receiver lever (16) swingably upward so that said receiver lever (16) is moved to its unlocked position; and when said locking plate (5) is held in its locked position, said locking plate (5) has its locking end portion (25) engaged with said restriction portion (26) of said slider (21) to prevent said receiver lever (16) from turning on said first pivot (17).

3. The door locking handle assembly with a built-in combination as set forth in claim 1, wherein:

said combination lock (6) is provided with a plurality of cam discs (41) which are used for changing the combination of marks for unlocking, which marks are provided on the peripheral surfaces of said dial discs (4), by engaging with and disengaging from said marked dial discs (4);

each of cam discs (41) is provided with a detecting groove (71) on its peripheral surface;

said handle (2) is provided with a plurality of openings (75) which permit a resetting member (72) to access to said peripheral surface of each of said cam discs (41);

said resetting member (72) is contacted on the peripheral surface of each of said cam discs (41) through said opening (75);

each of said predetermined mark of each of said marked dial discs (4) for unlocking is detected by turning each of said marked dial discs (4) until said resetting member (72) is brought into engagement with each of said detecting grooves (71).

4. The door looking handle assembly with a built-in combination lock as set forth in claim 2, wherein:

said combination lock (6) is provided with a plurality of cam discs (41) which are used for changing the combination of marks for unlocking, which marks are provided on the peripheral surfaces of said dial discs (4), by engaging with and disengaging from said marked dial discs (4); each of cam discs (41) is provided with a detecting groove (71) on its peripheral surface;

said handle (2) is provided with a plurality of openings (75) which permit a resetting member (72) to access to said peripheral surface of each of said cam discs (41);

said resetting member (72) is contacted on the peripheral surface of each of said cam discs (41) through said opening (75) and;

each of said predetermined marks of each of said marked dial discs (4) for unlocking is detected by turning each of said marked dial discs (4) until said combination of marks is changed and reset.

5. The door locking handle assembly of claim 1, wherein said combination lock (6) includes said plurality of said marked dial discs (4) in an alternating relationship with an equal number of adjacent cam discs (41), said dial discs (4) and said cam discs (41) being rotatably mounted on a center pin (20).

6. The door locking handle assembly of claim 5, wherein said marked dial discs (4) can each be interlocked to each adjacent said cam disc (41) by a plurality of positioning projections (45) which are each inserted axially into a mating positioning groove (46).

7. The door locking handle assembly of claim 5, wherein each said marked dial disc (4) has a plurality of positioning grooves (65) provided equally spaced apart on the dial disc outer periphery, each said dial disc (4) being held in a predetermined angular position by a third spring member (66) fixedly mounted in said handle (2).

8. The door locking handle assembly of claim 5, wherein said door handle (2) has an elongated hollow portion (38) covered by a back plate member (39).

9. The door locking handle assembly of claim 1, wherein said base body (1) is fixedly mounted onto said door (30) by a mounting plate (34) having a U-shaped form and a screw (35) fastening means.

10. In a door locking handle assembly with a built-in combination lock (6), the assembly being provided with a base body (1) which is fixedly mounted on a door (30) of a box, wherein a door handle (2) is pivoted to said base body (1) so as to be capable of being pulled out forward and pushed back rearward relative to said base body (1) and also turned sideward on a locking shaft (29) after completion of its pulling-out operation, wherein a locking member (3) serves for locking said door (30) to a main body of said box is directly or indirectly connected with said door handle (2) so as to be engaged with and disengaged from a receiving portion of a stationary frame element when said door handle (2) is pulled out forward and then turned sideward on said locking shaft (29) after completion of the pulling-out operation of said door handle (2), the improvement wherein:

said combination lock (6), which is provided with a plurality of marked dial discs (4), is incorporated in said door handle (2) and opened by turning each of said marked dial discs (4) a given number of times to establish a predetermined combination of marks provided in outer peripheral surfaces of said dials discs (4);

said plurality of dial discs (4) being provided in an alternating relationship with an equal number of adjacent cam discs (41), said dial discs (4) and said cam discs (41) being each rotatably mounted on an elongated center pin (20), wherein said marked dial discs (4) can be interlocked to each adjacent said cam disc (41) by a plurality of positioning projections (45) which are inserted axially into a mating positioning groove (46);

said combination lock (6) is held in its locked condition when said predetermined combination of marks of said dial discs (4) is not established;

a cylinder lock (13) is incorporated in said door handle (2) and disposed adjacent to said combination lock (6) in a longitudinal direction of said door handle (2), wherein said cylinder lock (13) is provided with a rotor (8);

when a key (7) is inserted into a keyhole (9) of said rotor (8) of said cylinder lock (13), said cylinder lock (13) has its internal lock mechanism (10) unlocked to permit said rotor (8) to be turned by said key (7) thus inserted into said keyhole (9) of said rotor (8); so that when said rotor (8) is turned, a stopping plate (11) which is slidably received in a side through-hole (12) of said door handle (2) is driven in a manner such that said stopping plate (11) is projected outward from said side through-hole (12) and retracted from the outside of said door handle (2);

said stopping plate (11) has its upper end portion (14) abut against a shoulder portion (15) of a lower surface of a proximal end portion of a pivoted receiver lever (16);

said shoulder portion (15) of said receiver lever (16) is provided with a cam slope (18) through which said receiver lever (16) is pushed upward by said upper end portion of said stopping plate (11);

said receiver lever (16) is rotatably urged toward said stopping plate (11) by means of a first spring member (19);

a slider (21) is disposed in parallel with said center pin (20) of said combination lock (6), and urged toward said cylinder lock (13) by means of a second spring member (22) in a manner such that a lower end portion (23) of said slider (21) abuts against an upper surface of said receiver lever (16), so that said slider (21) has its restriction portion (26) engaged with and disengaged from a locking end portion (25) of a lock plate (5) when said lock plate (5) is held in its locked position and its unlocked position, respectively;

when said lock plate (5) is held in its unlocked position, said door handle (2) is capable of being pulled forward out of said base body (1);

when said door handle (2) is thus pulled out forward, said stopping plate (11) pushes said cam slope (18) of said receiver lever (16) swingably upward so that said receiver lever (16) is moved to its unlocked position;

when said lock plate (5) is held in its locked position, said lock plate (5) has its locking end portion (25) engaged with said restriction portion (26) of said slider (21) to prevent said receiver lever (16) from turning on pivot (17);

each of said cam discs (41) being provided with a detecting groove (71) provided on its peripheral surface;

said handle (2) being provided with a plurality of openings (75) which permit a resetting member (72) to access to said peripheral surface of each said cam disc (41); and each of said marks of each of said marked discs (4) for unlocking is detected by turning each of said marked discs (4) until each resetting member (72) is brought into engagement with each of said detecting grooves (71).

* * * * *